US009382674B1

(12) United States Patent
Knapp

(10) Patent No.: US 9,382,674 B1
(45) Date of Patent: Jul. 5, 2016

(54) CONCRETE FINISHING MACHINE

(71) Applicant: Ronald A. Knapp, Bonita Springs, FL (US)

(72) Inventor: Ronald A. Knapp, Bonita Springs, FL (US)

( * ) Notice: Subject to any disclaimer, the term of this patent is extended or adjusted under 35 U.S.C. 154(b) by 0 days.

(21) Appl. No.: 14/681,316

(22) Filed: Apr. 8, 2015

Related U.S. Application Data

(62) Division of application No. 13/967,095, filed on Aug. 14, 2013, now Pat. No. 9,028,168.

(60) Provisional application No. 61/682,954, filed on Aug. 14, 2012.

(51) Int. Cl.

| | |
|---|---|
| ***E01C 19/25*** | (2006.01) |
| ***E01C 19/26*** | (2006.01) |
| ***E01C 19/22*** | (2006.01) |
| ***E01C 19/23*** | (2006.01) |
| ***E01C 7/00*** | (2006.01) |

(52) U.S. Cl.
CPC . *E01C 19/26* (2013.01); *E01C 7/00* (2013.01); *E01C 19/22* (2013.01); *E01C 19/23* (2013.01)

(58) Field of Classification Search
CPC ..... E01C 7/00; E01C 19/22; E01C 19/23; E01C 19/26
USPC ..... 404/83, 84.1, 103
See application file for complete search history.

(56) References Cited

U.S. PATENT DOCUMENTS

| | | | |
|---|---|---|---|
| 4,128,359 | A | 12/1978 | Cooper, Jr. et al. |
| 4,314,773 | A | 2/1982 | Allen |
| 4,614,486 | A | 9/1986 | Bragagnini |
| 4,655,633 | A | 4/1987 | Somero et al. |
| 4,930,935 | A | 6/1990 | Quenzi et al. |
| 4,964,754 | A | 10/1990 | Garner et al. |
| 4,993,869 | A | 2/1991 | Ulmer et al. |
| 5,062,738 | A | 11/1991 | Owens |
| 5,562,361 | A | 10/1996 | Allen |
| 5,664,908 | A | 9/1997 | Paladeni |
| 5,988,939 | A | 11/1999 | Allen et al. |
| 6,129,480 | A | 10/2000 | Cunningham |
| 6,234,713 | B1 | 5/2001 | Rowe et al. |
| 6,350,083 | B1 | 2/2002 | Paladeni |
| 6,402,425 | B1 | 6/2002 | Paladeni |
| 6,695,532 | B2 | 2/2004 | Somero et al. |
| 7,559,719 | B2 | 7/2009 | Nasby |
| 7,704,012 | B2 | 4/2010 | Lura |
| 8,137,026 | B2 | 3/2012 | Lura |
| 8,152,409 | B1 | 4/2012 | Ligman |
| 8,419,313 | B2 | 4/2013 | Lura |
| 2002/0141822 | A1 | 10/2002 | Sterner |
| 2009/0092444 | A1 | 4/2009 | Schoen |

*Primary Examiner* — Raymond W Addie
(74) *Attorney, Agent, or Firm* — Erickson Kernell IP, LLC

(57) ABSTRACT

A concrete finishing machine includes a mobile frame supported above the slab on front and rear wheels with at least one screed roller and a plurality of vibrators are suspended from the frame between the front and rear wheels. The front and rear wheels are rotatable at least ninety degrees between a longitudinally directed traveling orientation and a laterally directed concrete finishing orientation. The front and rear wheels are driven and steerable so that the mobile frame may travel longitudinally down a lane of a road, and then upon pivoting of the wheels, move laterally over a hole in an adjacent lane having uncured concrete to be finished by the finishing machine.

13 Claims, 31 Drawing Sheets

CONCRETE FINISHING MACHINE

CROSS-REFERENCE TO RELATED APPLICATIONS

This application is a division of U.S. patent application Ser. No. 13/967,095 filed Aug. 14, 2013 Now U.S. Pat. No. 9,028,168, which claims the benefit of U.S. provisional patent application Ser. No. 61/682,954, filed Aug. 14, 2012, under 35 U.S.C. §119(e).

BACKGROUND OF THE INVENTION

1. Field of the Invention

The present invention is directed to a machine for finishing uncured concrete placed including uncured concrete placed in a hole in a slab and for paving concrete surfaces.

2. Background of the Invention

With reference to the section of road shown in FIGS. 5-8 of the drawings, a common practice for repairing damaged sections of concrete slabs 2 forming the road is to cut out and remove a damaged section and pour and finish a concrete patch in the remaining hole. The area around lateral control joints 5 formed in the slabs 2 which have degraded over time are areas that are commonly in need of repair. The concrete slab 2 forming a road is typically poured as a generally continuous slab. The slab may be approximately nine to twelve inches thick. Saw cuts are then cut into the slab 2, commonly about one third of the thickness of the pavement, to provide an area of weakness at which cracks will naturally form in the slab 2. Longitudinal joints 6 are formed longitudinally along the slab 2 to separate lanes that are typically twelve feet wide. Lateral control joints 5 are formed laterally across the slab 2 typically approximately fifteen feet apart.

Damage at the lateral control joints 5, typically starts with chipping and spawling of the edges of the joint 5, forming a small depression which then grows as tires continuously pound against the defect and water seeps into the cracks therein and freezes further expanding the defects. Over time cracks will also form extending outward from the joint 5. In addition, cracks may form across the slab between control joints 5 which is more common when the spacing between control joints 5 is increased, such as for example thirty foot spacings.

A typical procedure for repairing a slab having a degraded control joint 5 is to cut out and remove a specified amount of the concrete slab 2 on either side of the degraded joint 5. The width of the slab to be removed may vary depending on specifications established by the jurisdiction in charge of the road repair. Typically, the jurisdiction or owner will specify removing at least two to three feet of the concrete slab 2 on either side of the joint 5 and in some cases up to approximately five feet on either side of the joint 5.

In repairs, cuts 11 are made through the concrete slab at the distance specified from the crack on both sides. Holes are then drilled in the fragmented section to be removed. Expansion pins are then inserted into the holes and expanded to lock the pins in the holes. The pins are connected together by a harness that is then lifted with an excavator or the like to lift the pins and the fragmented section connected thereto from the rest of the concrete roadway or slab 2 to leave a hole 15 in the roadway to be filled with a patch 17.

After the fragmented section is removed, concrete is placed or poured in the remaining hole 15 and leveled and finished to present a relative smooth upper surface. Shovels and rakes are still commonly used to level out high spots. Vibrators held by hand or mounted on a mobile truss and inserted into the uncured concrete are also used to level the concrete by vibrating and increasing the fluidity of the poured mass so it levels by gravity. Once the poured concrete is generally leveled, screeds are then used to finishing the concrete to generally smooth out the upper surface filling any voids and compacting the concrete. Screeds used for finishing concrete may be as simple as a 2×4 board drawn over the concrete at a level to which the concrete is to be finished. Truss screeds comprising an elongated truss or rigid member with a motor mounted thereon to vibrate the truss may be used for screeding. In addition, motor driven rollers pulled by hand over a section of concrete to be finished or mounted on a mobile frame are also known for use in finishing poured concrete. Such screeds are typically referred to as roller screeds.

Road patching operations, particularly in and around cities, often must be completed between evening and morning rush hours while maintaining at least one lane in each direction open to traffic. Quick curing concrete is used in such patching operations. Such quick curing concrete can be formulated to cure to the degree required to support traffic within as little as approximately 4 hours. The water content of the quick curing concrete is relatively low such that its viscosity is high and its fluidity or slump is low. Such quick curing concrete is more difficult to level and finish even using motor driven roller screeds that are pulled by two workers.

As shown in U.S. Pat. No. 5,562,361, it is also known to mount rollers to a frame and drive each roller by a motor projecting outward therefrom. The rollers are supported on the surface adjacent the concrete to be leveled and finished which can be the surrounding slab as discussed above or forms surrounding a mass of concrete or other structure. The rollers not only level the uncured concrete but propel the machine across the concrete and along the forms or surrounding surface. The exposed motors connected to the rollers are prone to damage and increase the overall width or length of the roller assembly and may make it difficult to use such machines for leveling concrete close to curbs or other structures. In addition, such machines are made relatively long to accommodate a wide variety of widths of areas to be finished making the machine difficult to maneuver into place which may be done using a crane to lift the machine in place.

There remains a need for a system for finishing concrete used to patch sections of a road which can be readily used in situations in which access to lanes adjacent the lane repaired may be limited and which is easy to use by a limited number of operators. There also remains a need for a system for finishing concrete which can rapidly move to the mass of concrete to be finished and quickly transition from a traveling mode to a finishing mode and which overcomes the limitations of existing finishing machines.

SUMMARY OF THE INVENTION

The present invention is directed to a concrete finishing machine for finishing uncured concrete such as concrete placed in a hole in a slab such as a slab forming part of a lane of a road. The hole is created by removing a damaged section of the road, typically around an expansion joint. The concrete finishing machine may also be used in other applications for leveling an finishing concrete including concrete poured between forms. The finishing machine includes a mobile frame supported above the slab on at least one front wheel and at least one rear wheel and preferably a pair of front wheels and a pair of rear wheels. At least one of the front and rear wheels is driven. The front and rear wheels are rotatable at least ninety degrees between a longitudinally directed orientation and a laterally directed orientation. The front and rear driven wheels are steerable so that the mobile frame may travel longitudinally down a lane of a road, and then upon pivoting of the wheels, move laterally over a hole in an adjacent lane having uncured concrete to be finished by the finishing machine.

At least one roller or screed roller, which rotates about a horizontal axis, is suspended from the frame in a generally longitudinal orientation. When the front and rear wheels are oriented in the laterally directed orientation the front and rear wheels are spaced longitudinally outward from the ends of the screed roller so that the front and rear wheels can straddle a hole in a slab while the finishing machine supports the screed roller and moves the screed roller across the uncured concrete placed in the hole.

The frame includes a base frame to which the front and rear wheels are connected and a roller support frame comprising front and rear laterally extending support members and a longitudinal roller support from which the at least one screed roller is suspended. In a preferred embodiment, the laterally extending support members telescope laterally relative to the base frame. The longitudinal roller support telescopes longitudinally and is pivotally connected at opposite ends to the front and rear laterally extending support members such that the screed roller may be supported at an angle relative to a longitudinal axis of said base frame through extension of one of the front and rear laterally telescoping support members further than the other of the front and rear laterally telescoping support members. A preferred embodiment includes two screed rollers, each suspended below a longitudinal roller support telescopingly and pivotally connected between the laterally extending support arms.

The base frame to which the front and rear wheels and the laterally telescoping support members are attached preferably telescopes longitudinally. In addition, a plurality of screed rollers, preferably two, are suspended from the laterally telescoping support members. As with the first screed roller, the second screed roller is suspended from a longitudinally telescoping roller support member which is pivotally connected at opposite ends to the front and rear laterally telescoping support members so that both the first and second screed rollers may be supported at an angle relative to the base frame by extending one laterally telescoping support member further than the other.

The first screed roller is preferably connected to a first section of the first longitudinally telescoping roller support member which is fixedly connected longitudinally to the front laterally telescoping support member. The second screed roller is connected to a first portion of the second longitudinally telescoping roller support member which is fixedly connected longitudinally to the rear laterally extending support member. Upon extension of the longitudinally telescoping roller support members, the first screed roller is drawn forward and the second screed roller is drawn rearward.

The screed rollers preferably are suspended from the frame by first and second vertically extendable and retractable support members connected to opposite ends of the screed roller. Each screed roller preferably comprises a tube having a first hub connected to the tube in inwardly spaced relation from a first end thereof and a second hub connected to the tube proximate a second end thereof. The second hub is rotatably connected to the second vertical support member and rotates freely relative thereto. A drive motor is fixedly connected to the first vertical support member. A drive shaft, at an end of the motor opposite the first vertical support member, drivingly engages the first hub to rotate the tube relative to the first and second vertical support members. In a preferred embodiment, the drive motor extends completely within the roller tube.

Riser wheels are connected to the vertical support arms for the screed rollers on opposite ends thereof and are operable to space the roller tube in closely spaced relation above the slab. A first riser wheel is rotatably mounted on a first riser wheel mount which is connected to the first vertical support member outward from the first end of the roller tube. A second riser wheel is rotatably mounted on a second riser wheel mount which is connected to the second vertical support member outward from the second end of the roller tube. The first and second riser wheel mounts are vertically adjustable relative to the roller tube such that the axes of rotation of the first and second riser wheels are vertically adjustable in a plane extending vertically through the axis of rotation of the roller tube.

In one embodiment, the first and second riser wheel mounts are slidably mounted relative to the roller tube and first and second vertically adjustable stops selectively restrain vertical sliding of the first and second riser wheel mounts to hold a lower peripheral edge of each of the first and second riser wheels below a lower peripheral edge of the roller tube. The lower peripheral edge of the riser wheels are supported on the slab and space the lower peripheral edge of the roller tube above the slab. Typical vertical spacing of the roller tube above the slab is on the order of one sixteenth to one quarter of an inch.

In situations in which the concrete finishing machine cannot travel longitudinally in a lane next to the hole to be finished, a frame lifting assembly may be utilized to allow the front wheels to first pass over the hole so that the front and rear wheels straddle the hole and then to lift the rear wheels over the hole without tracking through the finished concrete. The frame lifting assembly includes a front frame lift assembly and a rear frame lift assembly. The front frame lift assembly comprises at least one and preferably two longitudinally telescoping front lift arms connected to the frame and having a front lift wheel connected to a distal end of the respective front lift arm by a jack. Each of the front lift arms are selectively extendable forward of the front drive wheels to position the associated front lift wheel in spaced relation in front of the front drive wheels. In use, when the front drive wheels advance to just behind the hole to be filled and finished, the front lift arms may be extended to position the front lift wheels above the slab on an opposite side of the hole. The front jacks are then extended to lower the front lift wheels to the slab and to then raise the front lift arms and a front end of the frame to raise the front frame support wheels above the slab. Once the front frame support wheels are lifted above the slab, the rear frame support wheels are driven forward to advance the front frame support wheels across the hole and over the slab on an opposite side thereof. The front jacks are then retracted to lower the front end of the frame and the front frame support wheels and then raise the front lift wheels off of the slab.

The rear frame lift assembly comprises at least one and preferably two longitudinally telescoping rear lift arms connected to the frame and having a rear lift wheel connected to a distal end of the respective rear lift arm by a jack. The rear lift arms are selectively extendable rearward of the rear frame support wheels to position the rear lift wheels in spaced relation behind the rear frame support wheels. In use, after finishing the concrete in the hole, with the front frame support wheels in front of the hole and the rear frame support wheels positioned behind the hole, the jacks on the rear lift arms are extended to lower the rear lift wheels to the slab and to then raise the rear lift arms and a rear end of the frame to raise the rear frame support wheels above the slab. Once the rear frame support wheels are lifted above the slab, the longitudinally telescoping rear lift arms are extended while driving the front frame support wheels forward to advance the rear frame support wheels across and above the finished concrete in the hole in the slab. Once the rear support frame wheels are advanced over the slab on an opposite side of the hole, the rear jacks are then retracted to lower the rear end of the frame and the rear frame support wheels and then raise the rear lift wheels off of the slab. The longitudinally telescoping rear lift arms may then be retracted.

A towing accessory assembly may be added to the concrete finishing machine to facilitate towing the machine at relatively high speeds to a work site. The towing assembly includes a wheel chassis pivotally mounted at one end of the base frame and a tongue with a coupler at an outer end thereof is pivotally mounted to the base frame at an opposite end. Hydraulic actuators connect the wheel chassis and the tongue to the base frame and are operable to lower the wheel chassis to the ground and the coupler onto a hitch ball connected to a truck. Further lowering of the wheel chassis and tongue relative to the concrete finishing machine raises the concrete finishing machine off of its wheels so the machine is supported by wheels connected to the wheel chassis and the truck through the tongue and coupler. The wheel chassis and tongue may be raised to lower the concrete finishing machine back onto its wheels.

The concrete finishing machine preferably also includes at least one vibrator suspended from the frame by a vertically extendable and retractable vibrator support assembly operable to lower a vibratable head of the at least one vibrator into the uncured concrete placed in the hole in the slab and to raise the vibratable head thereabove. In a preferred embodiment, a plurality of vibrators are mounted on the vertically extendable and retractable vibrator support assembly. In one embodiment, the vibrator support assembly is pivotally connected to the laterally telescoping support members which support the screed rollers and the vibrator support assembly telescopes longitudinally. The vibrators may also be secured to a support bar which is slidably mounted to the longitudinally telescoping support for the outer screed roller so that the vibrators may slide longitudinally relative to the longitudinally telescoping support.

Wipers may also be mounted on the structure for supporting the screed rollers and positioned in front of the screed roller to wipe uncured concrete back into the hole having concrete being leveled by the concrete finishing machine. The wipers are positioned to extend across the edge of the structure in which the uncured concrete is positioned such as an existing slab adjacent a hole in which concrete has been poured. A float, presenting a flat bottom surface may also be removably secured around one of the screed rollers.

A leveling guide comprising a string is strung across each of the longitudinally telescoping roller supports to detect drooping or downward deflection of an inner end of the telescoping members forming the longitudinally telescoping roller support. The leveling guide can also be used to draw the end of the screed roller spaced away from the laterally telescoping support arm to be raised or lowered relative to the end of the roller supported in close proximity below the lateraly telescoping support arm to adjust a vertical angular orientation of the screed roller.

DETAILED DESCRIPTION OF THE PREFERRED EMBODIMENTS

Figure 1:
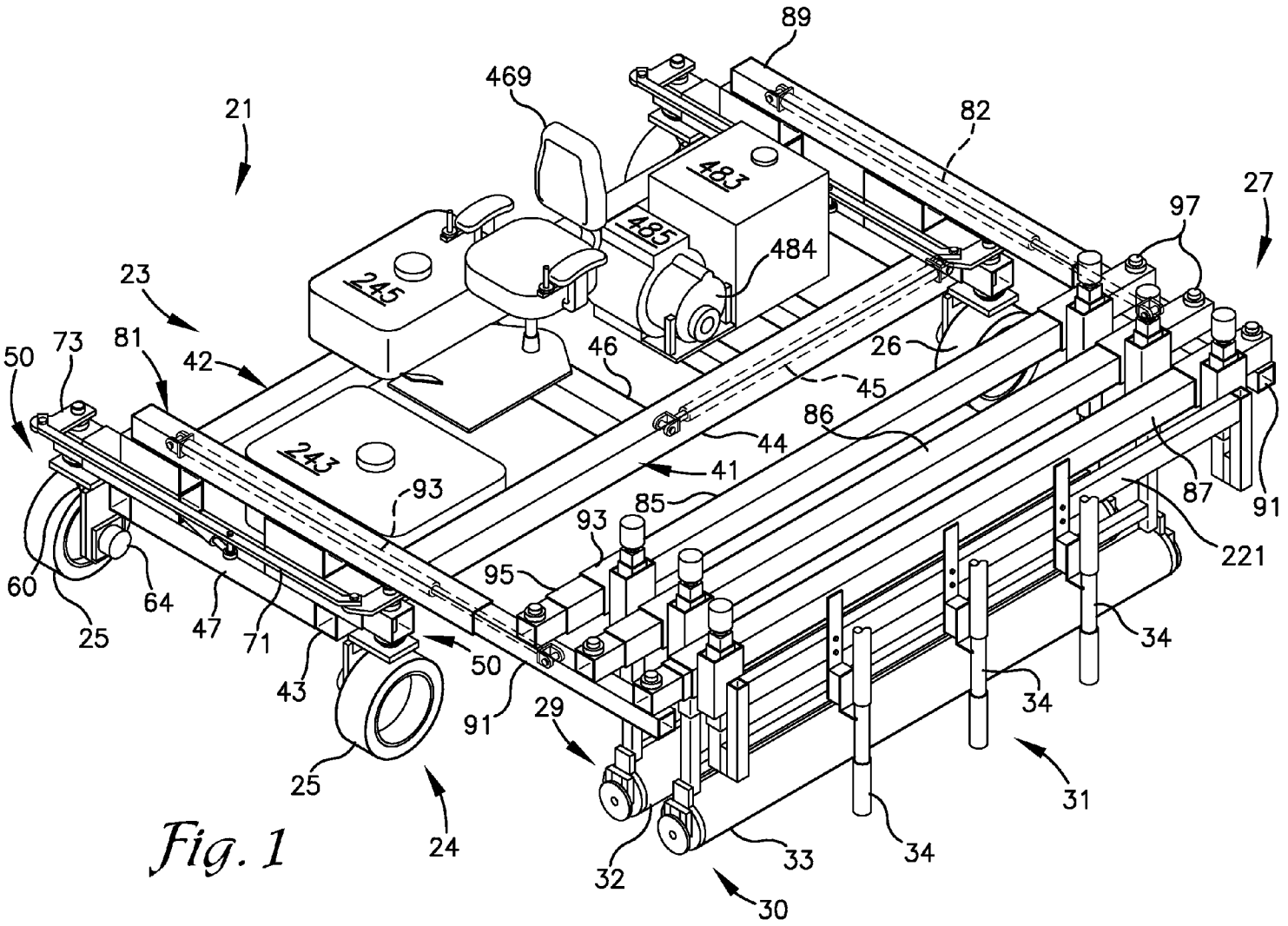
FIG. 1 is a perspective view of a concrete finishing machine for leveling and finishing a mass of uncured concrete and having a longitudinally telescoping base frame, a longitudinally and laterally telescoping roller support frame supporting a screed roller therebelow and a longitudinally telescoping frame lift assembly for use in traversing a hole.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof. The drawings submitted herewith are in an informal format. In some views components that should be hidden from view are shown in solid lines. For example, in FIGS. 3-7, hydraulic actuators are shown in solid lines although the actuators are contained within telescoping tubes. The actuators should be shown in dashed lines or removed. Formal drawings addressing the lines which should be hidden will be submitted with any regular utility patent application claiming priority herefrom.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from respectively, the geometric center of the embodiment being described and designated parts thereof. Said terminology will include the words specifically mentioned, derivatives thereof and words of a similar import.

Referring to the drawings in more detail, the reference number 21 generally designates a self-propelled, concrete finishing machine for finishing a mass of concrete poured or placed into a hole 15 from which a fragmented slab has been removed from the surrounding lane 2. When describing the concrete finishing machine 21 herein, directional references are generally made with reference to the direction of travel of the finishing machine 21 along a lane of the road in the intended direction of traffic thereon as shown by the arrow in FIG. 5. The concrete finishing machine 21 includes a telescoping, mobile base frame or chassis 23 supported on four wheels 24 including a front pair of wheels 25 and a rear pair of wheels 26. The finishing machine 21 further includes a telescoping, finisher support frame 27 mounted on the chassis 23 and which supports first and second roller assemblies 29 and 30 and a vibrator assembly 31 along one side of the chassis 23. First and second screed rollers 32 and 33 are rotatably supported on first and second roller assemblies 29 and 30 respectively and a plurality of vibrators 34 are mounted on the vibrator assembly 31 in a downwardly projecting orientation. The finisher support frame 27, first and second roller assemblies 29 and 30 and vibrator assembly 31 may collectively be referred to as the finisher assembly 35.

Figure 6:
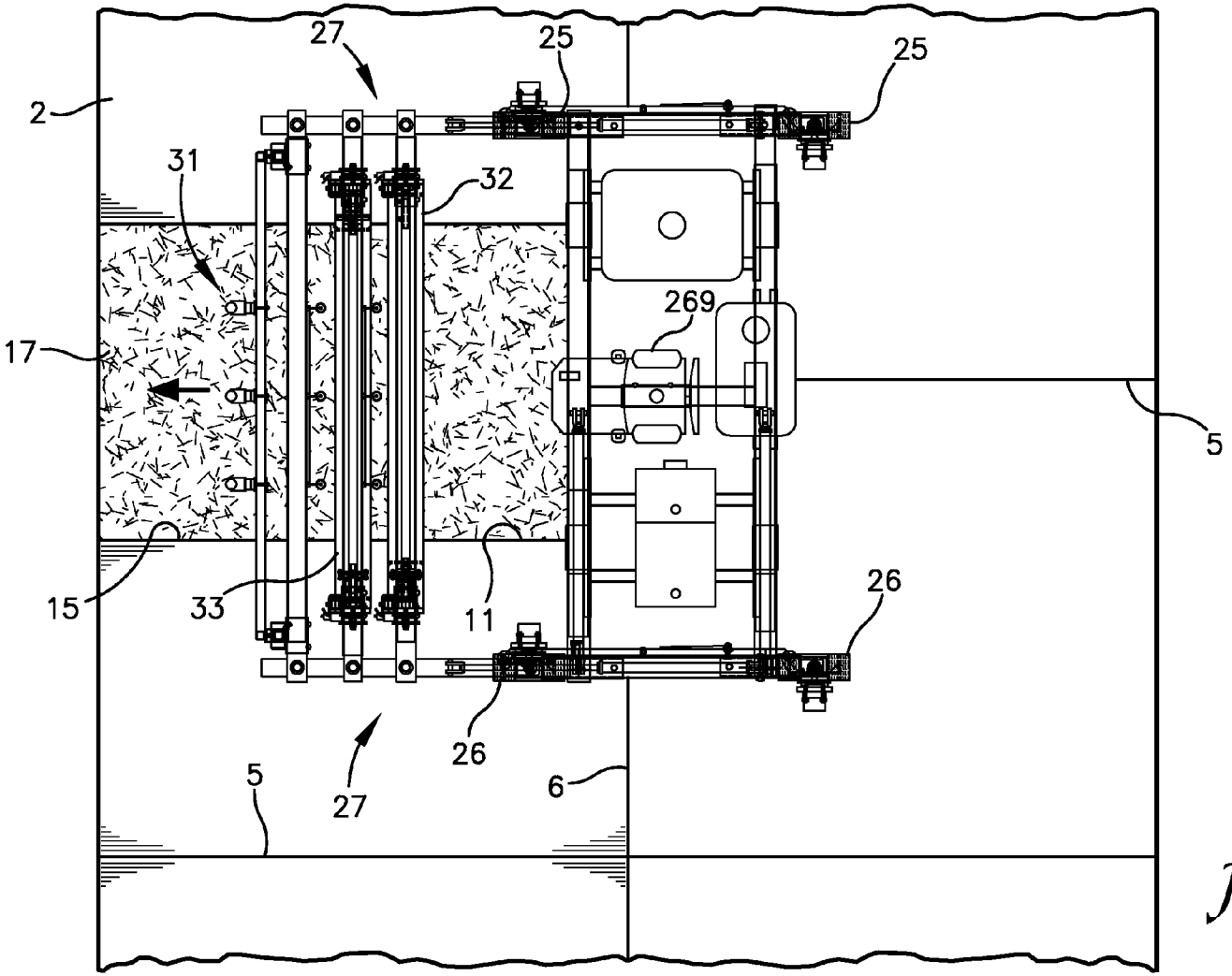
FIG. 6 is a top plan view showing the concrete finishing machine in a finishing mode with front and rear wheels of the finishing machine straddling the hole having uncured concrete to be finished and the roller support frame supporting two screed rollers and three vibrators over the hole.
Figure 8:
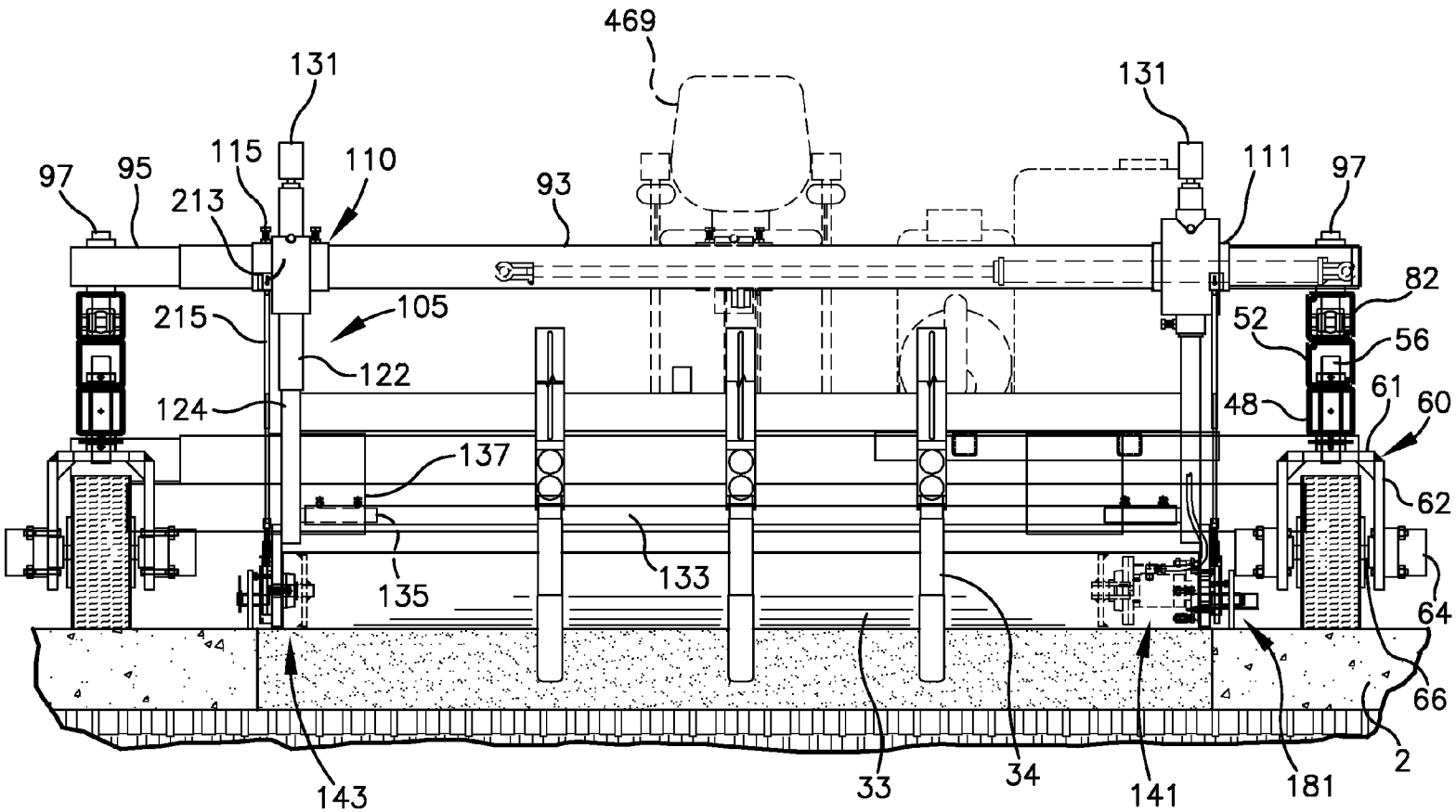
FIG. 8 is a left side elevational view of the concrete finishing machine in the finishing mode as shown in FIG. 7 with portions removed or shown in phantom lines for clarity.

The wheels 24 preferably pivot at least ninety degrees, and preferably approximately 135 degrees or more about an axis extending vertically through the center of the wheel, to allow the concrete finishing machine 21 to travel either longitudinally along a lane of a road or laterally across one or more lanes of the road without turning or having to turn the chassis 23. The finishing machine 21 travels longitudinally down a lane of a road, generally adjacent to the lane having the hole 15 (which is either empty or already contains uncured concrete to be finished) until the finisher reaches the hole 15. As best seen in FIGS. 6 and 8, the front and rear pairs of wheels 25 and 26 are spaced apart on the chassis 23 wide enough so that they can support the concrete finishing machine 21 in a straddling relationship over a hole 15 with the front and rear pair of wheels 25 and 26 supported on the concrete slab 2 on opposite sides of the hole 15. The finishing machine 21 can then move laterally, in straddling relationship, over the hole 15 for finishing the uncured concrete placed therein using the vibrator assemblies 31 and roller assemblies 29 and 30.

Figure 4:
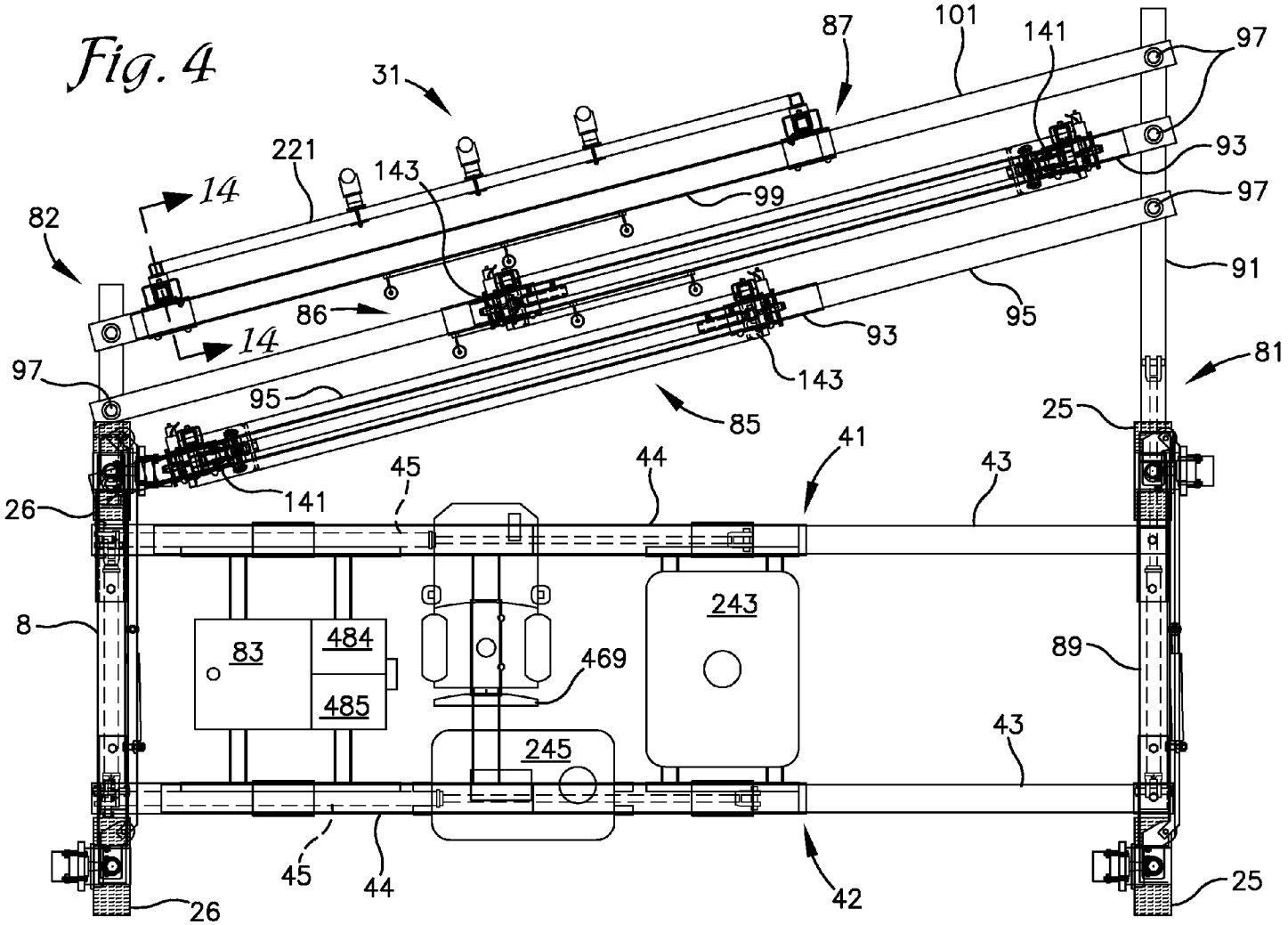
FIG. 4 is a top plan view of the concrete finishing machine in an alternative finishing mode showing the base frame and the laterally telescoping roller support frame extended longitudinally and a front laterally telescoping roller support frame member extending further laterally than a rear laterally telescoping roller support frame member to orient the longitudinally telescoping roller support members connected therebetween at an angle.
Figure 5:
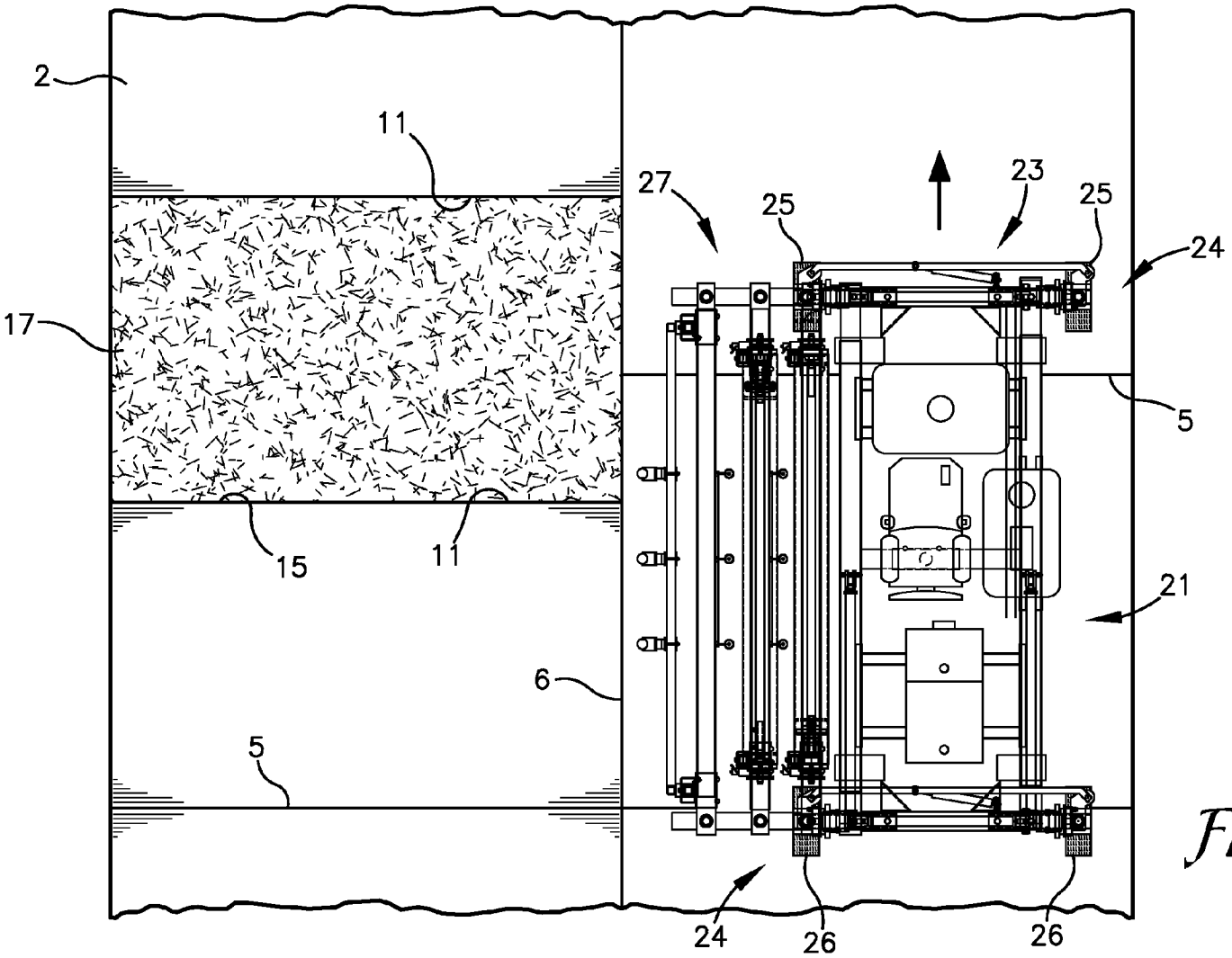
FIG. 5 is a top plan view showing the concrete finishing machine in a traveling mode traveling in a lane adjacent the lane having a hole filled with uncured concrete to be finished.

As shown in FIG. 4, the chassis 23 telescopes or expands longitudinally to increase the spacing between front and rear pairs of wheels 25 and 26 to permit straddling of longitudinally wider holes 15. The finisher support frame 27 similarly telescopes or expands longitudinally in conjunction with longitudinal expansion of the chassis 23 to permit finishing of longitudinally wider holes 15. The finisher support frame 27 also telescopes laterally relative to the chassis 23 to vary the spacing between the roller assembles 29 and 30 and the vibrator assembly 31 relative to the chassis 23. As described in more detail hereafter, longitudinal members forming the finisher support frame 27 telescope and pivot relative to lateral members so that the longitudinal members and the attached roller assemblies 29 and 30 and vibrator assembly 31 may be oriented at an acute angle relative the chassis 23, such as shown in FIG. 4. Angling of the roller assemblies 29 and 30 may be used to facilitate moving the relatively dense quick setting uncured concrete from one side of the hole 15 toward another side.

Figure 17:
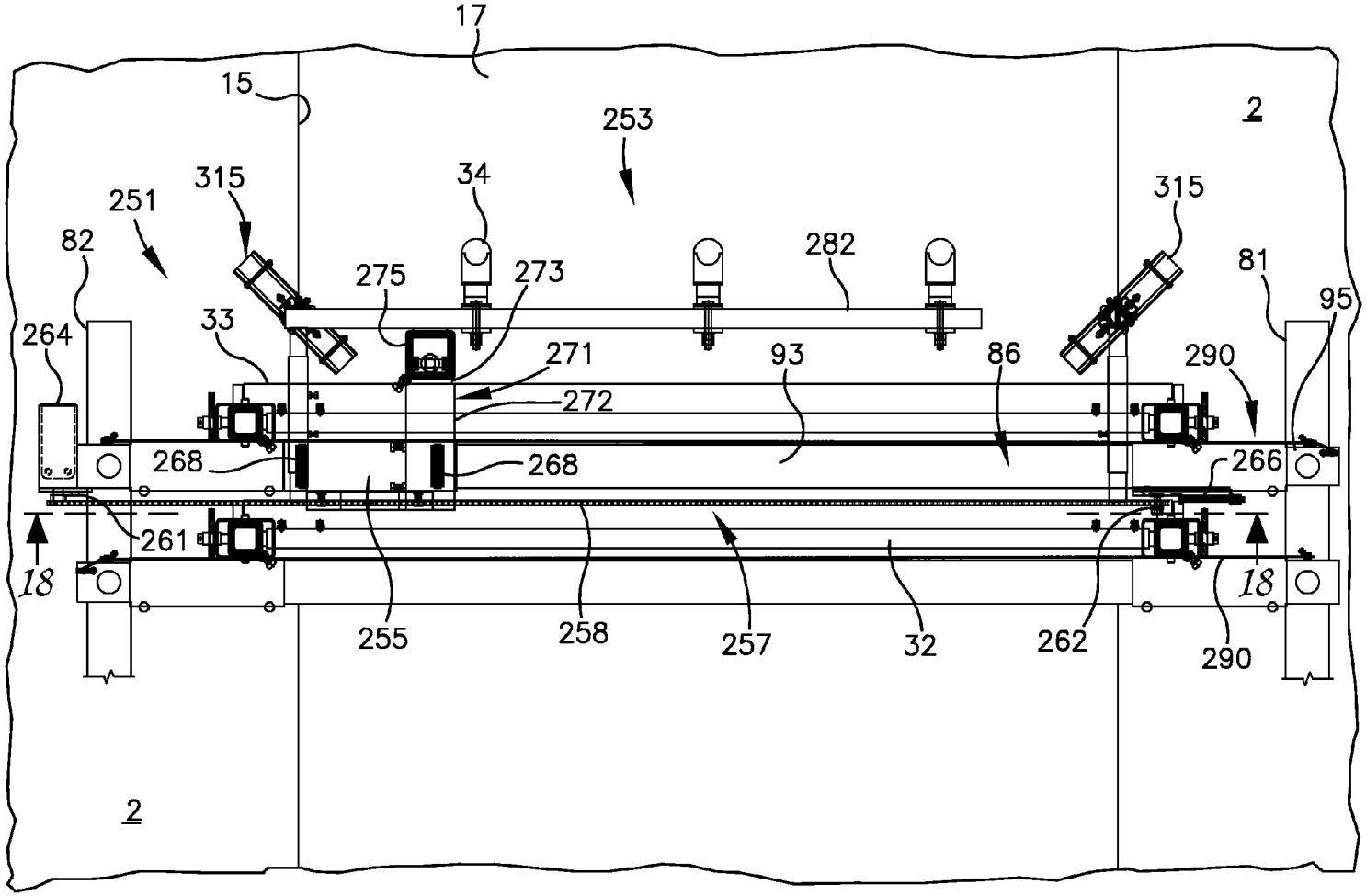
FIG. 17 is a fragmentary, top plan view of an alternative embodiment of a finisher assembly shown retracted and positioned over a hole in a slab to be finished.
Figure 18:
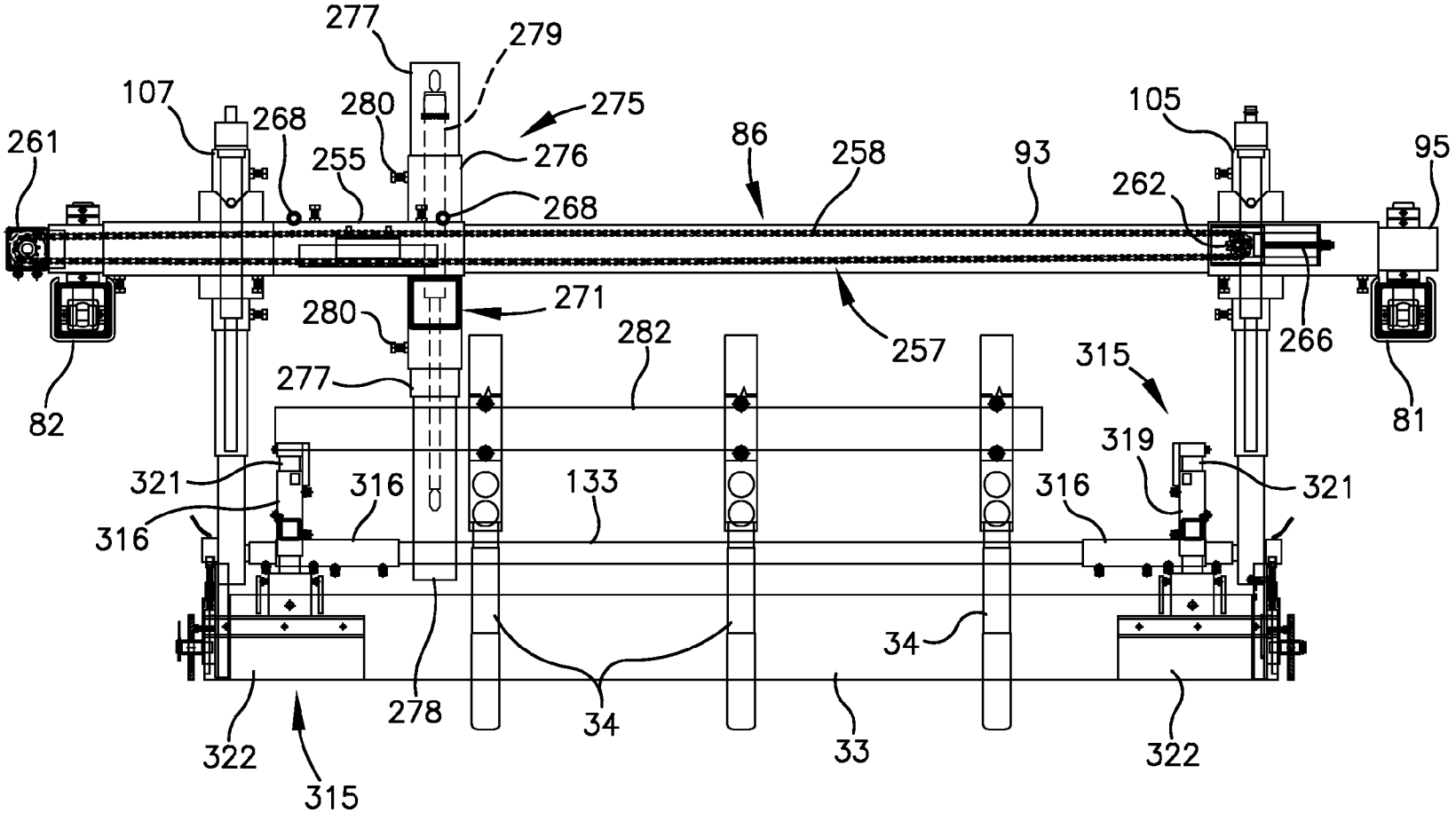
FIG. 18 is a cross-sectional view of the alternative finisher assembly taken along line 18-18 of FIG. 17.
Figure 19:
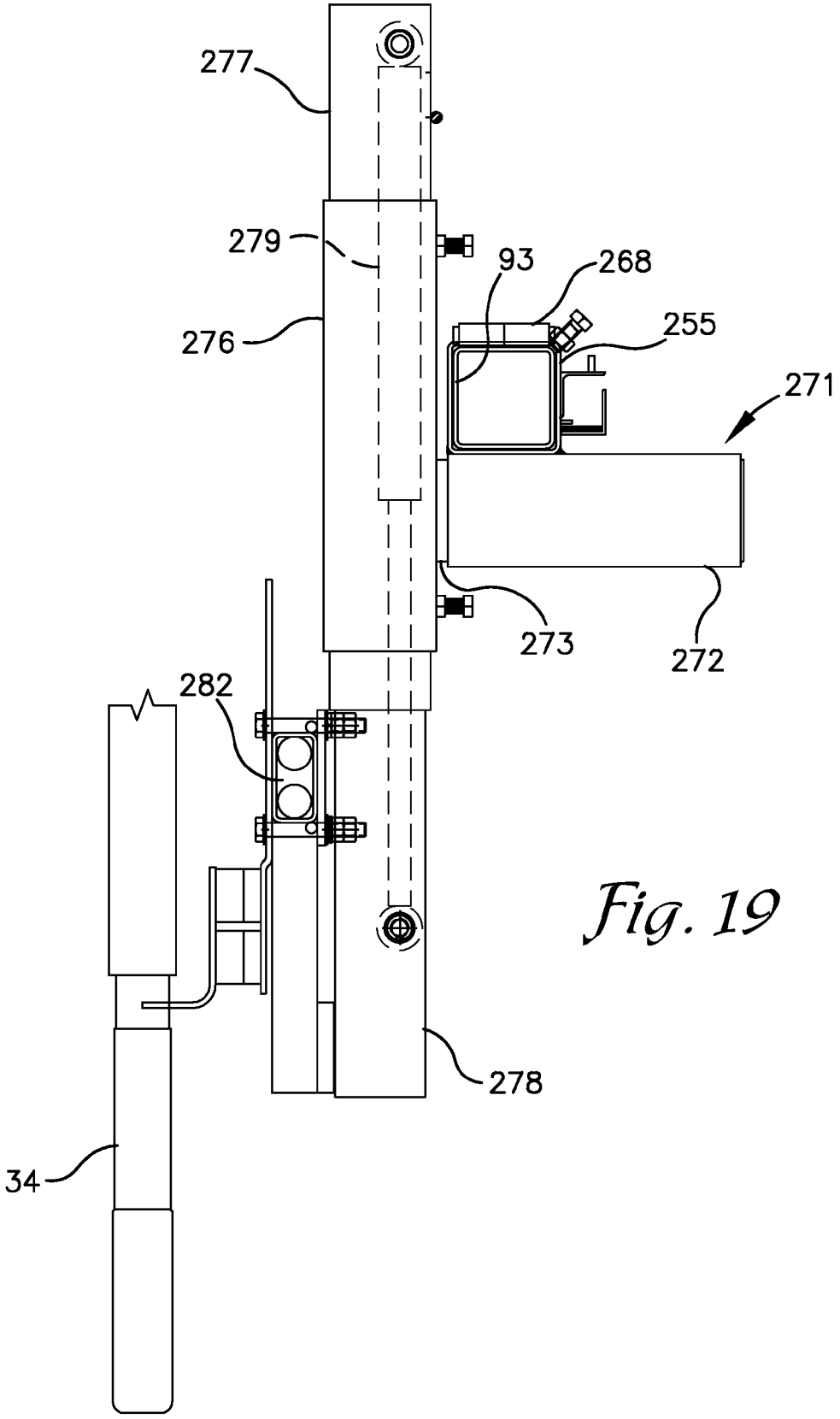
FIG. 19 is an enlarged and fragmentary view of a vibrator support assembly for the alternative finisher assembly as shown in FIG. 17.

As shown in FIGS. 17-19, the finishing machine 21 may also include a patch traversing assembly 37 mounted to the chassis 23 to permit lifting of the chassis 23 and front and rear wheels 25 and 26 connected thereto over a hole 15 that is empty or containing finished but uncured concrete. The patch traversing assembly 37 is adapted for use when access to a lane adjacent the lane containing the hole 15 to be patched cannot be used and the shoulder is too narrow to accommodate the finishing machine 21. As used herein, and unless specified otherwise, the shoulder may be considered a lane.

Chassis

Figure 7:
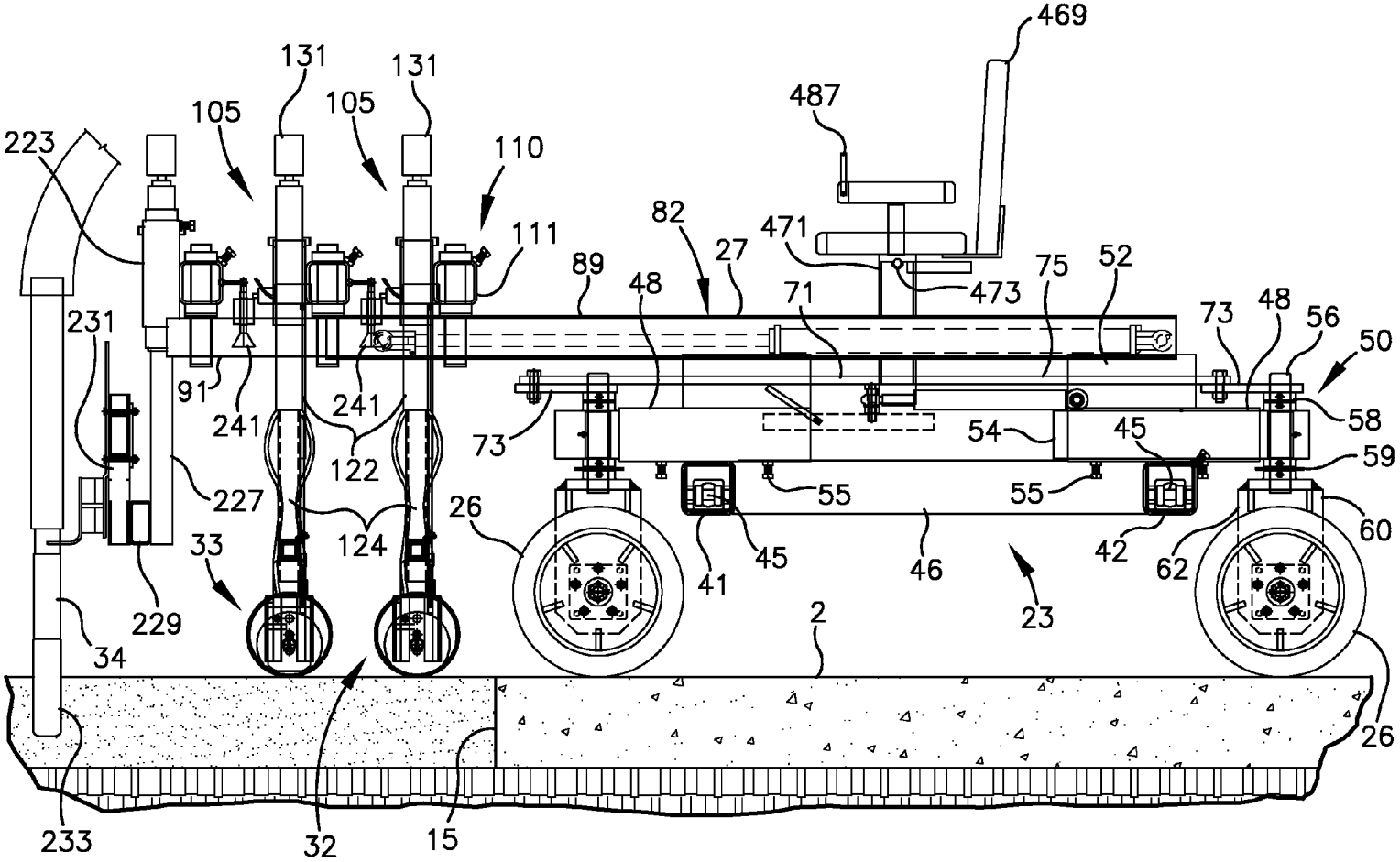
FIG. 7 is a rear elevational view of the concrete finishing machine in the finishing mode showing the screed rollers and vibrators lowed into working positions for finishing uncured concrete placed in the hole.

The chassis 23, as best seen in FIGS. 4 and 7 includes first and second telescoping longitudinal base frame members 41 and 42 each including an inner tube 43 slidingly received within an outer tube 44 and interconnected by a hydraulic actuator 45 mounted within tubes 43 and 44. Cross-beams 46 are welded to and extend between the outer tubes 44 of the longitudinal base frame members 41 and 42 near the distal ends and near the center thereof securing the longitudinal base frame members 41 and 42 in parallel spaced relation. A cross beam 47 also extends between distal ends of the inner tube 43 of the longitudinal base frame members 41 and 42.

Square tube receivers 48 adapted to receive and secure a portion of a wheel mounting assembly 50 for each of the wheels 25 and 26 are welded or mounted on each end of the first and second telescoping longitudinal base frame members 41 and 42. One of the square tube receivers 48 is mounted on each of the two outer tubes 44 near a rear of the chassis 23 and one of the square tube receivers 48 is mounted on each of the two inner tubes 43 near a front of the chassis 23. The square tube receivers 48 are oriented transverse to and project outward from the longitudinal base frame members 41 and 42 and the square tube receivers 48 on each end of the chassis 23 extend in axial alignment. A vertical spacer 52, formed from square tubing, is welded to and extends above each square tube receiver 48 and the finisher support frame 27 is connected to and supported on the upper surface of the vertical spacers 52.

Each of the wheels 24 is mounted on a wheel mounting assembly 50 having a shank 54 formed from square tubing sized for reception and securement within one of the square tube receivers 48. Set screws or bolts 55 extending through the receiver 48 and engaging shank 54 are used to removably secure the shank 54 within receiver 48. A pivot pin or shaft 56 extends through an end of the shank 54 projecting outward from receiver 48 and is pivotally mounted to the shank 54 by upper and lower bearing assemblies 58 and 59. An L-shaped wheel support bracket 60 is fixedly secured to a lower end of the pivot pin 56. A horizontal leg 61 of bracket 60 is welded to a bearing forming part of lower bearing assembly 59 which is fixedly connected to a lower end of pivot pin 56 and a vertical leg 62 of bracket 60 projects downward from horizontal leg 61. A hydraulic wheel motor 64 is mounted on a first side of the vertical leg 62 near a lower end thereof with a drive shaft 66 projecting through the vertical leg 62 and to which a wheel 24 is mounted. The wheel 24 is mounted on the bracket 60 so that it is positioned directly below pivot pin 56 with a vertical axis through the center of the wheel 24 aligned with a vertical axis of the pivot pin 56.

Figure 2:
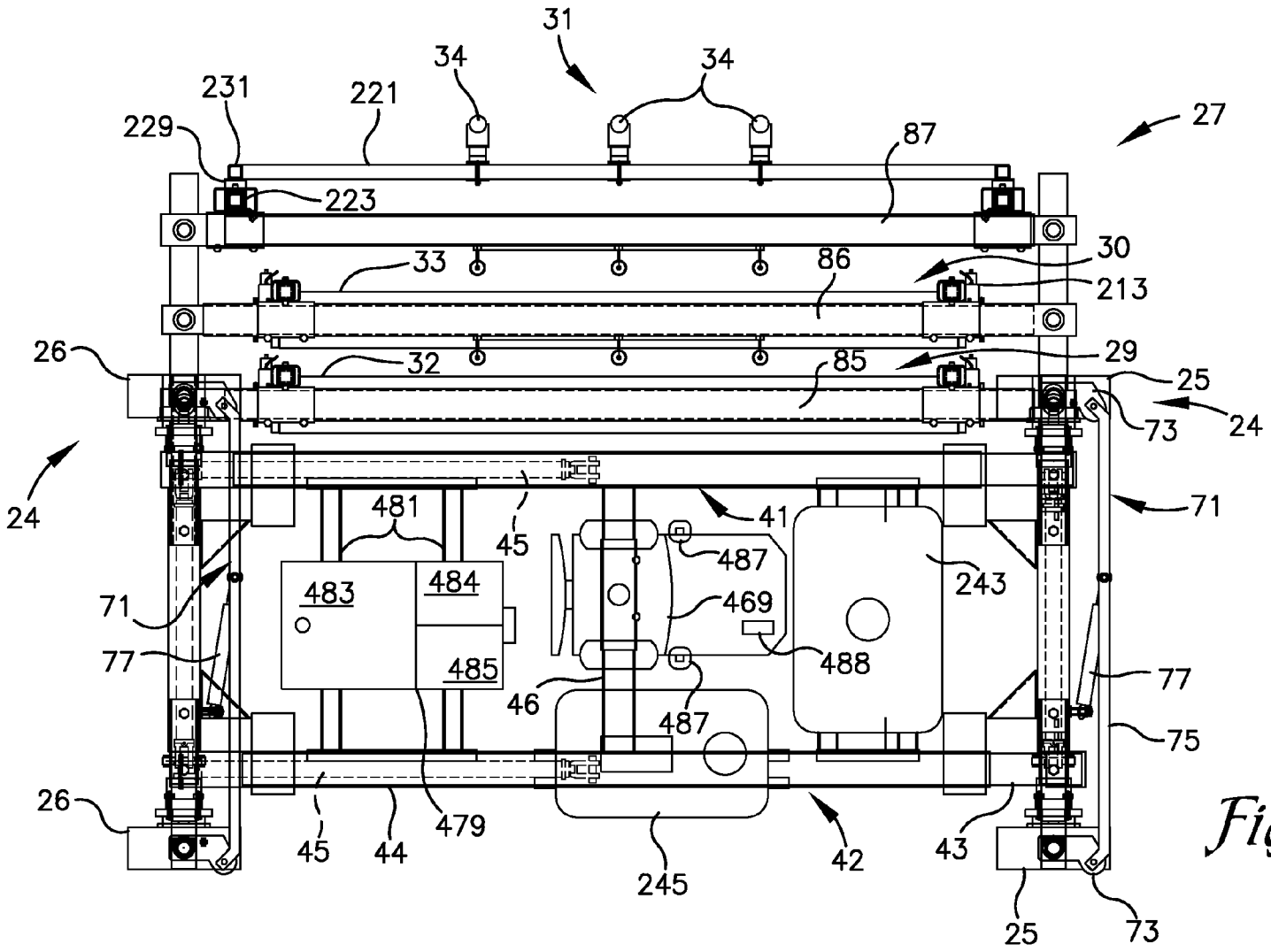
FIG. 2 is a top plan view of the concrete finishing machine in a travelling mode with the base frame, roller support frame and frame lift assembly all retracted and front and rear drive wheels oriented to roll longitudinally relative to a surface such as a slab of a road.
Figure 3:
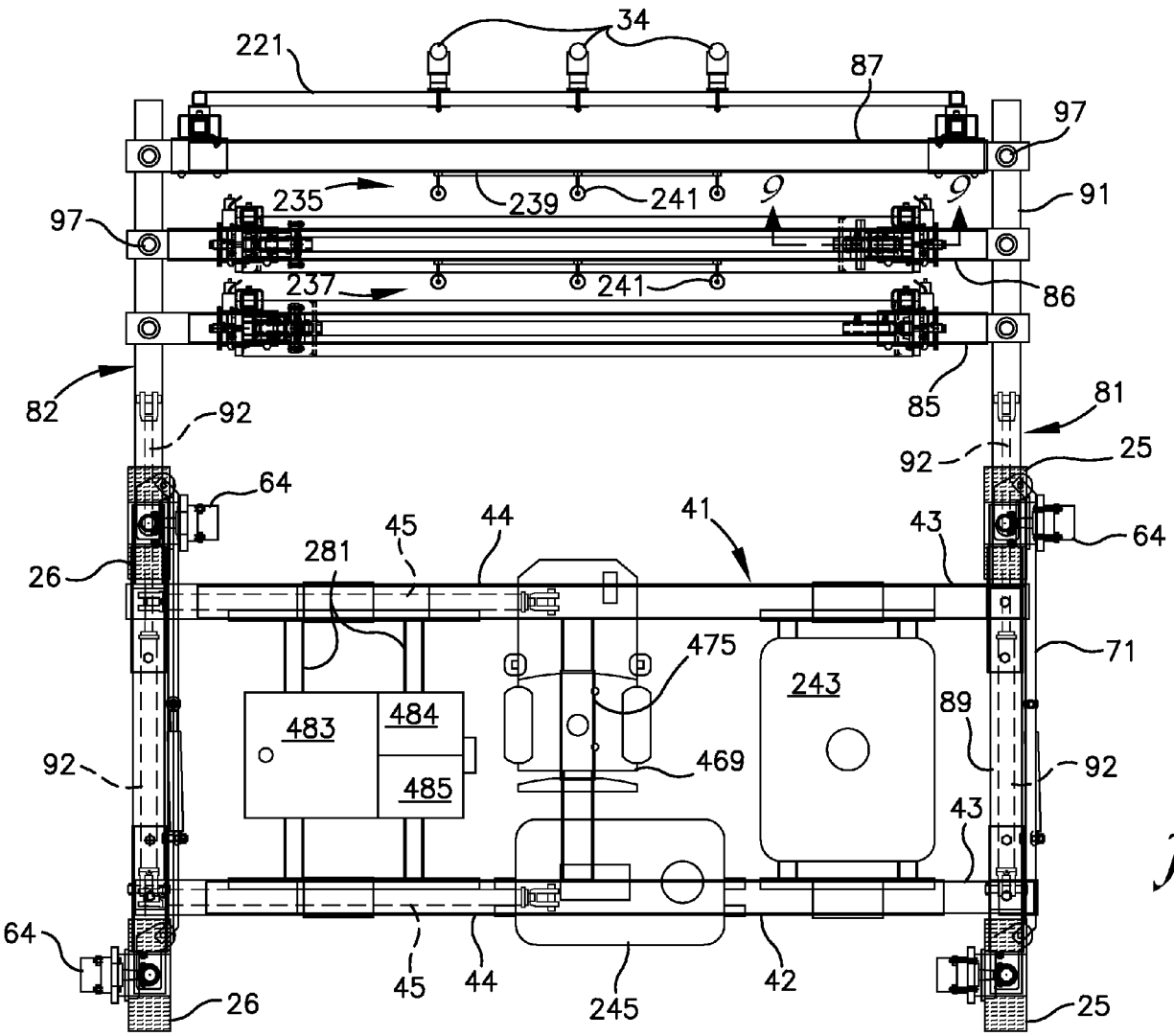
FIG. 3 is a top plan view of the concrete finishing machine in a finishing mode showing the laterally telescoping roller support frame extended laterally and the front and rear drive wheels rotated ninety degrees and oriented to roll laterally relative to the slab.

Each of the wheels 24 in wheel pairs 25 and 26 are connected together by steering linkage 71. Horizontally projecting, dog leg brackets 73 having a bend of approximately 135 degrees are welded to a bearing forming part of upper bearing assembly 58 which is fixedly secured to an upper end of each pivot pin 56. Opposite ends of a tie rod 75 are pivotally connected to distal ends of the dog leg brackets 73 connected to each of the front and rear pairs of wheels 25 and 26. A front tie rod 75 interconnects the front pair of wheels 25 and a rear tie rod 75 interconnects the rear pair of wheels 26. A hydraulic actuator or steering actuator 77 is connected between each tie rod 75, near a center thereof, and one of the spacers 52 on the chassis 23. The steering actuators 77 are extendable and retractable to pivot the wheels 24 at least ninety degrees between a longitudinal alignment to a transverse alignment. In the longitudinal alignment, as shown in FIG. 2, the wheels 24 are oriented to roll longitudinally to permit movement of the finishing machine longitudinally along a lane of the road. In the transverse or lateral alignment, as shown in FIG. 3, the wheels 24 are oriented to roll transversely to permit movement of the finishing machine 21 transverse to the lanes of the road. The ends of the tie rods 75 are also angled at angles of approximately 135 degrees to facilitate pivoting of the steering linkage 71 and associated wheels 24 more than ninety degrees to facilitate turning of the finishing machine 21 by more than ninety degrees.

Finisher Assembly

The finisher support frame 27 comprises front and rear telescoping lateral supports 81 and 82 supported on the front and rear spacers 52 of the chassis 23. First and second telescoping longitudinal roller supports 85 and 86 and a telescoping longitudinal vibrator support 87 are pivotally connected between the lateral support members 81 and 82. Each support member 81 and 82 comprises an outer tube 89 welded to a respective pair of spacers 52 on chassis 23 oriented transversely relative to the chassis 23 and an inner tube or extension arm 91 slidingly received within the outer tube 89. Each extension arm 91 is interconnected to a respective outer tube 89 by a hydraulic actuator 92 mounted within tubes 89 and 91. Actuators 93 are operable to extend and retract the extension arms 91 relative to the outer tubes 89 and laterally to one side of the chassis 23. The front and rear extension arms 91 can be extended and retracted independently of one another to pivot or angle the front and rear ends of the telescoping roller supports 85 and 86 and the telescoping vibrator support 87 relative to one another.

Each of the telescoping longitudinal roller support members 85 and 86 comprises an outer tube 93 and an inner tube 95 slidingly received therein. A distal end of the outer tube 93 is pivotally secured to the extension arm 91 of one of the front or rear lateral support members 81 or 82 and the distal end of the inner tube 95 is pivotally secured to the extension arm 91 of the other of the front or rear lateral support members 81 or 82. The pivotal connections between the outer and inner tubes 93 and 95 and the extension arms 91 are formed by pivot pin and bearing assemblies 97 of a conventional construction. The inner and outer tubes 95 and 93 of the longitudinal roller supports 85 and 86 slide freely within one another and extend and retract in response to expansion and retraction of the spacing between the front and rear telescoping lateral support members 81 and 82 resulting from expansion and retraction of the first and second longitudinal base frame members 41 and 42 by actuators 45.

As will be discussed in more detail hereafter, the first and second screed rollers 32 and 33 are connected to and suspended below the outer tubes 93 of the first and second longitudinal roller supports 85 and 86. In the embodiment shown, the outer tube 93 of the first or inner telescoping longitudinal roller support 85 is fixedly connected against longitudinal movement to the extension arm 91 of the rear telescoping lateral support member 82 and the outer tube 93 of the second or outer telescoping longitudinal roller support 86 is fixedly connected against longitudinal movement to the extension arm 91 of the front telescoping lateral support member 81. When the front lateral support member 81 is extended forward relative to the rear lateral support member 82 in response to extension of actuators 45, the outer tube 93 of the second longitudinal roller support 86 is drawn forward which in turn draws the second screed roller 33 longitudinally forward relative to the first screed roller 32. The screed rollers 32 and 33 are sized such that they remain in at least partially overlapping relationship when the front and rear telescoping lateral support members are extended to their maximum spacing and with the maximum angle between the ends of the telescoping longitudinal roller supports 85 and 86.

The telescoping longitudinal vibrator support 87 comprises an outer tube 99 and an inner tube 101 slidingly received therein. A distal end of the outer tube 99 is pivotally secured to the extension arm 91 of the rear lateral support member 82 and the distal end of the inner tube 101 is pivotally secured to the extension arm 91 of the front lateral support 81. The pivotal connections are formed by pivot pin and bearing assemblies 97 as used with the roller support members 85 and 86. The inner and outer tubes 101 and 99 of the vibrator support 87 slide freely within one another and extend and retract in response to expansion and retraction of the spacing between the front and rear telescoping lateral support members 81 and 82 resulting from expansion and retraction of the first and second longitudinal base frame members 41 and 42 by actuators 45.

Figure 14:
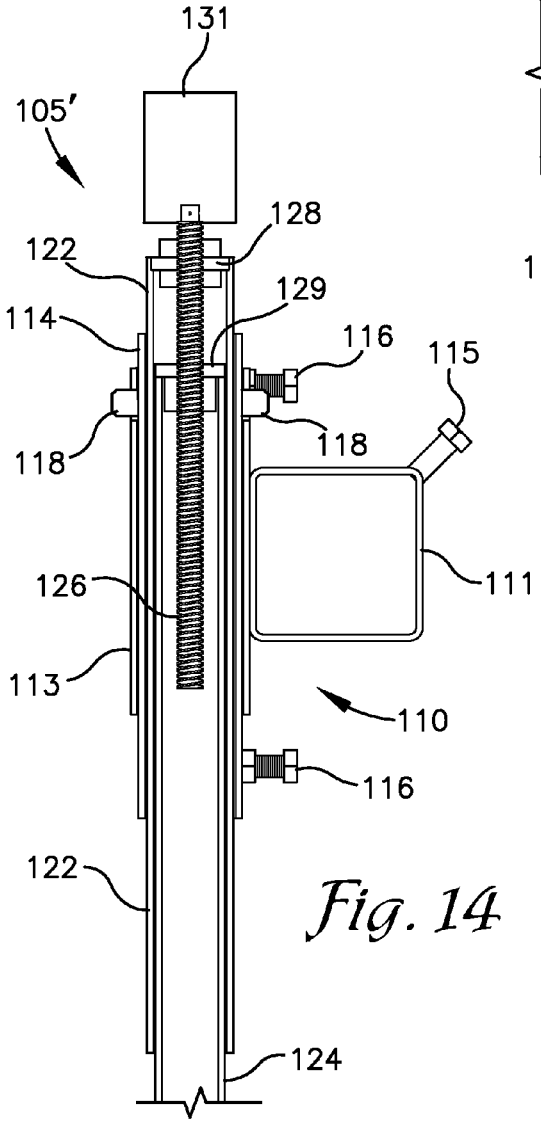
FIG. 14 is an enlarged and fragmentary cross-sectional view of a screw jack and a mounting assembly for mounting the screw jack assembly on a tube (not shown) taken generally along line 14-14 of FIG. 4.
Figure 15:
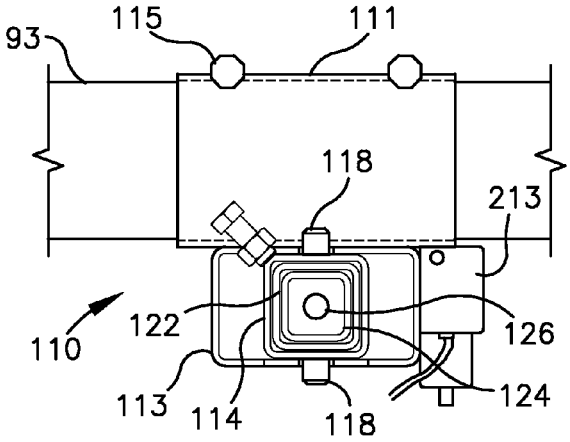
FIG. 15 is a fragmentary top plan view of the screw jack and mounting assembly shown attached to an outer tube of a telescoping roller support member.
Figure 16:
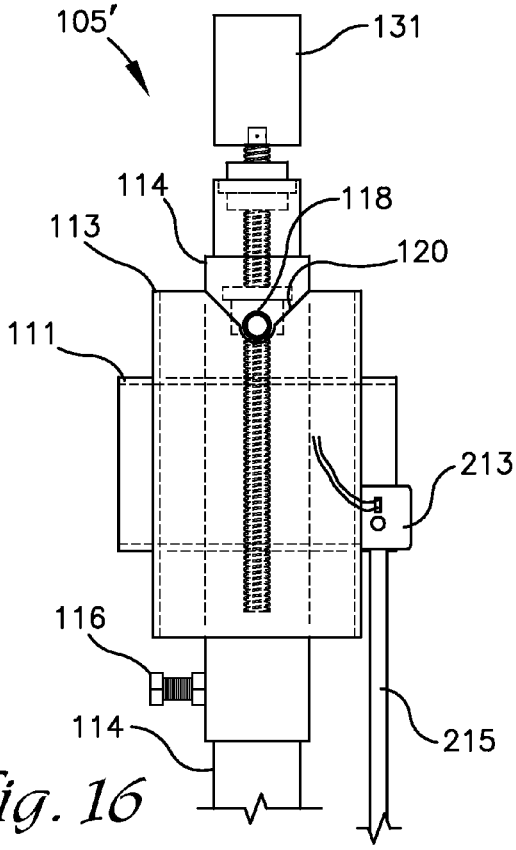
FIG. 16 is a left-side elevational view of the screw jack and mounting assembly as shown in FIG. 15.

As shown in FIGS. 7 and 8, the first and second screed rollers 32 and 33 are connected to and suspended below the outer tubes 93 of the first and second longitudinally telescoping roller supports 85 and 86 by front and rear vertically telescoping roller supports or vertically oriented screw jacks 105 and 107 supporting opposite ends of the screed rollers 32 and 33. Vertically telescoping roller supports 105 and 107 are independently operable to independently raise opposite ends of the screed rollers 32 and 33 so that one end of each roller may be supported at a different height than the opposite end. FIGS. 14-16 show details of a preferred and modified version of a screw jack 105' for supporting the screed rollers 32 and 33 which is slightly different than the version shown in FIGS. 1-8. Reference to screw jack 107', although not shown in the drawings, is intended to refer to a rear vertically telescoping roller support constructed similar to roller support 105' shown in FIGS. 14-16. It is noted that the screw jacks 233 associated with raising and lowering the vibrators 34, as shown in FIGS. 1-8 and in particular FIG. 7, are of the same construction as the screw jacks 105' as shown in FIGS. 14-16.

Referring to FIGS. 14-16, vertically telescoping roller support members 105' and 107' are connected to an outer tube 93 of a longitudinal roller support 85 and 86 by a mounting assembly 110 comprising a horizontal mounting sleeve 111 slidably mounted on outer tube 93, a vertical mounting sleeve 113 welded to and positioned laterally outward from or to the side of horizontal mounting sleeve 111 and a pivot sleeve 114 pivotally supported in the vertical mounting sleeve 113. The horizontal mounting sleeve 111 is slidably mounted on the outer tube 93 to permit adjustment of the spacing between the horizontal mounting sleeves 111 and the associated screw jacks 105' and 107' to accommodate screed rollers 32 and 33 of different lengths. The longitudinal positioning of the horizontal mounting sleeves 111 is fixed with set screws 115.

Each of the screw jacks or vertically telescoping roller supports 105' and 107' is secured in one of the pivot sleeves 114 which is pivotally supported on the vertical mounting sleeve 113 to permit pivoting of each of the vertically telescoping supports 105' and 107' about a horizontal, laterally extending axis. The vertical position of the screw jacks 105' and 107' relative to the respective pivot sleeve 114 is fixed with set screws 116. As best seen in FIG. 15, the vertical mounting sleeve 113 is wider than the pivot sleeve 113 which is supported on the vertical mounting sleeve 113 by pivot pins 118 projecting laterally outward from opposite sides of the pivot sleeve 113. The pivot pins 118 are supported in notches 120 formed in the upper edges of the vertical mounting sleeve 113 in laterally facing sides thereof such that the pivot pins 118 function as a trunnion to allow front to back pivoting of one end of a screed roller 32 or 33 supported by the screw jacks 105' and 107'. The pivoting of the screw jacks 105' and 107' and the screed roller 32 or 33 connected therebetween may also be described as side to side pivoting when the finishing machine 21 is viewed from the side and in the general direction of patch finishing. The vertical mounting sleeve 113 with notches 120 formed therein functions as a cradle for pivotally supporting the vertically telescoping roller supports 105' and 107'.

Each vertically telescoping roller support or screw jack 105 or 105' and 107 or 107' comprises an outer vertical tube 122 with an inner vertical tube 124 slidably mounted therein. The outer vertical tube 122 is received within and secured to the pivot sleeve 113 by set screws 116. The inner vertical tube 124 extends downward therefrom for supporting an end of a screed roller 32 or 33. The outer and inner vertical tubes 122 and 124 are interconnected by a linear actuator which in the embodiment shown is in the form of a screw 126. Other actuators, such as hydraulic actuators may also be used as the linear actuators. The screw 126 is threaded through threaded mounts or hubs 128 and 129 extending across upper ends of the outer and inner vertical tubes 122 and 124 respectively. The tubes 122 and 124 are preferably square in cross section so that they do not rotate relative to one another. The screw 126 is driven by a hydraulic motor 131 mounted on an upper end thereof and extending above an upper end of the outer vertical tube 122. Rotation of screw 126 draws the inner vertical tube 124 either toward or away from an upper end of the outer vertical tube 122 to raise and lower the end of the screed roller 32 or 33 associated therewith.

In screw jacks 105 and 107, the pivot pins 118 are mounted directly to the outer vertical tube 122 and not on a separate pivot sleeve. Provision of a separate pivot sleeve 114 for screw jacks 105' and 107', having pivot pins 118 mounted thereon, facilitates height adjustability of the entire screw jack 105' or 107' relative to the outer tube 93 of the roller support member 85 or 86 to which it is attached. In jack screw 105, with the pivot pin 118 mounted on the outer vertical tube 122, the outer tube 122 can only be positioned at a set height relative to the vertical mounting sleeve.

In the embodiments shown, the pivot pins 118 simply rest in the notches 120 of the vertical mounting sleeves 113 so that the vertically telescoping roller supports 105 or 105' and 107 or 107' are free to slide upward through the vertical mounting sleeve 113. Because the vertically telescoping roller supports 105 or 105' and 107 or 107' are free to slide upward relative to the vertical mounting sleeves 113, the screed rollers 32 and 33 may generally be described as floating or free floating relative to the upper surface of the uncured concrete being leveled thereby. The weight of the screed rollers 32 and 33 and the screw jacks 105 and 107 are sufficient to provide the weight necessary to level even relatively dense uncured concrete.

Abutment of the pivot pins 118 against the vertical mounting sleeves 113 in notches 120 does limit the distance below the finisher assembly 35 that the screed rollers 32 and 33 can extend. However, this distance is generally considerably greater than would be necessary in using the finishing machine to finish uncured concrete. The distance by which the screw jacks 105 and 107 can slide up through vertical mounting sleeves 113 is limited at least by a longitudinal support member 133 extending between the vertical supports 105 and 107. In this manner, the screed rollers 32 and 33 are free to float vertically through a somewhat limited range of motion which is more than sufficient for using the screed rollers 32 and 33 for their intend leveling and finishing functions.

Figure 9:
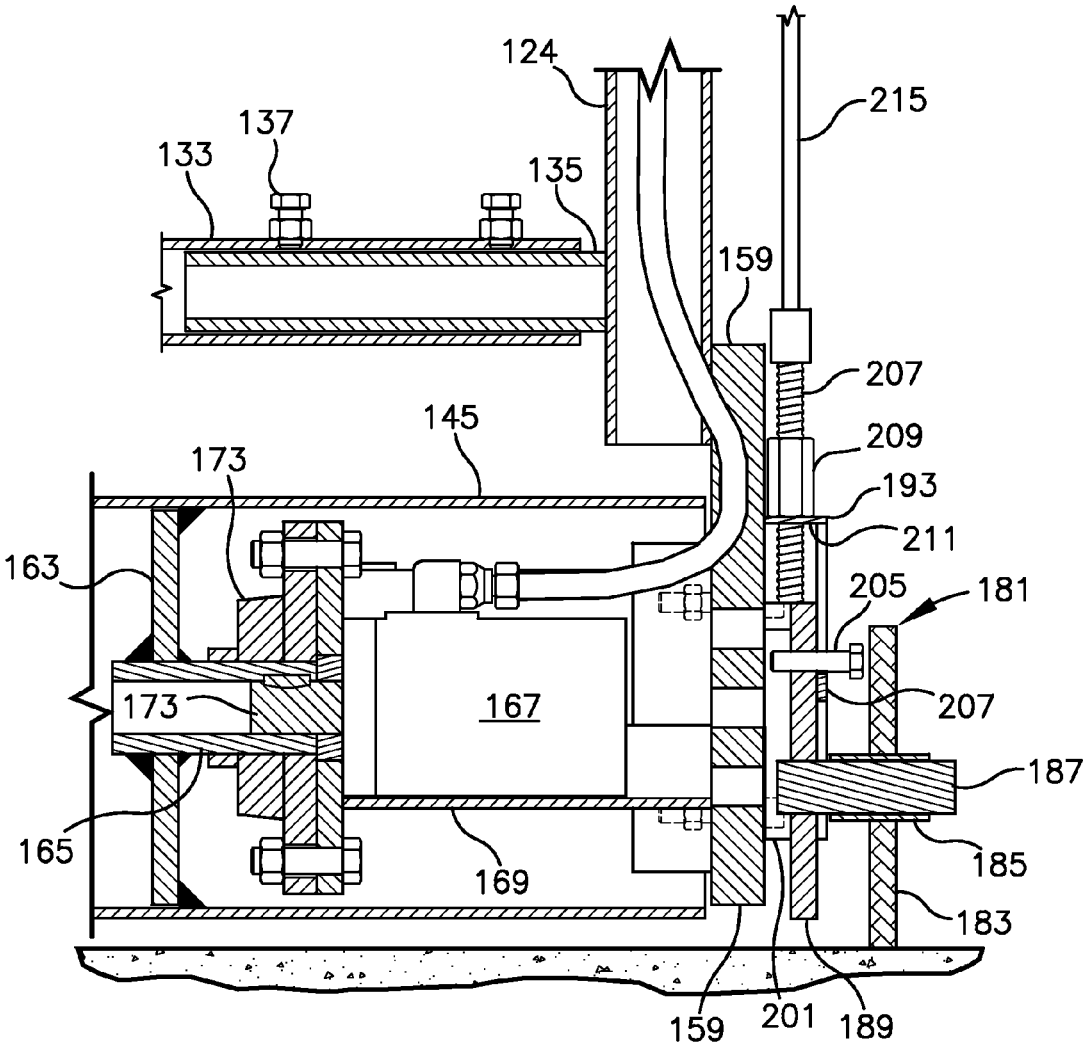
FIG. 9 is a fragmentary cross-sectional view of an end of a screed roller having a drive motor mounted within the roller tube taken generally along line 9-9 of FIG. 3.
Figure 10:
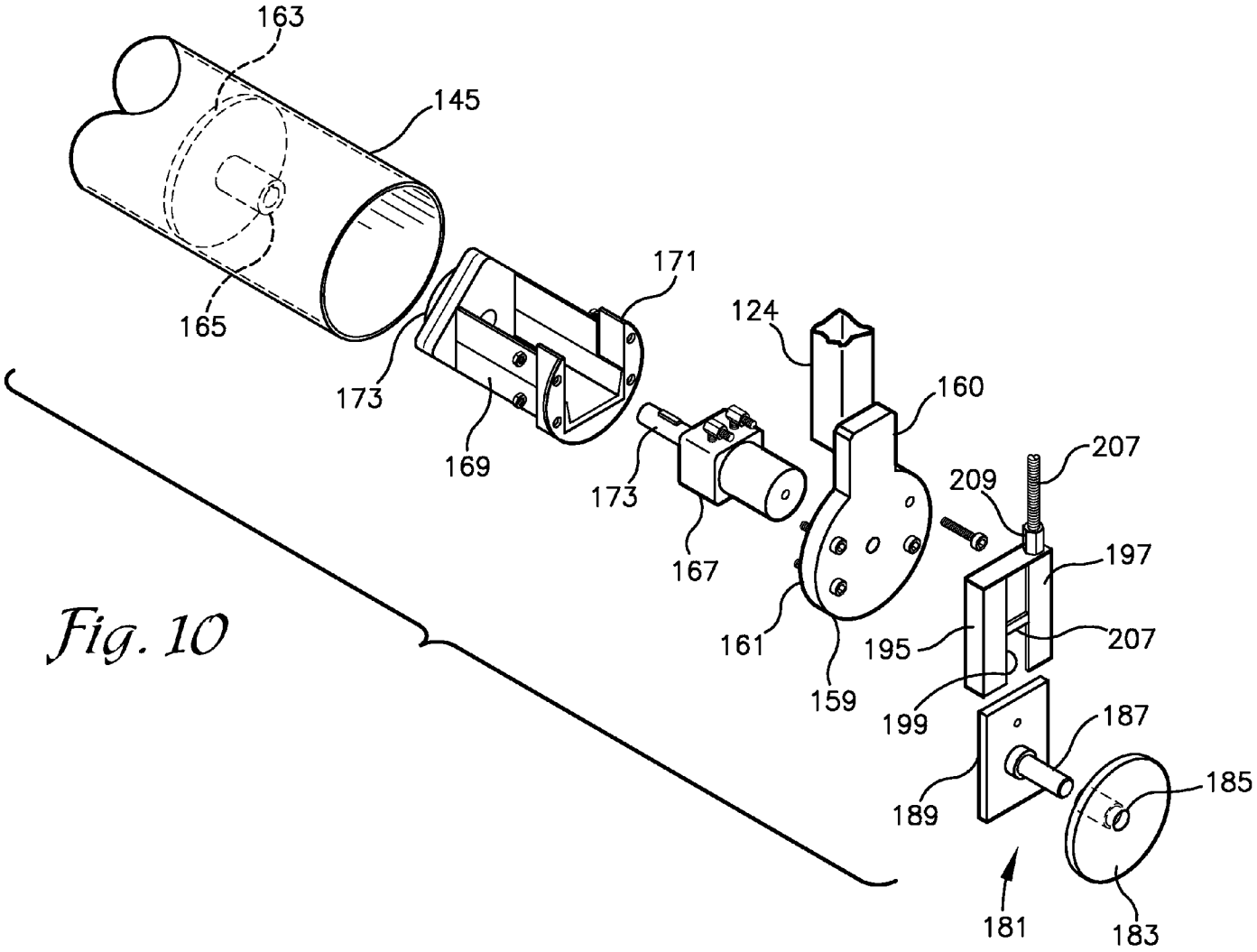
FIG. 10 is a fragmentary, exploded perspective view of the end of a screed roller showing the drive motor mounted therein and a riser wheel mounted thereto.
Figure 12:
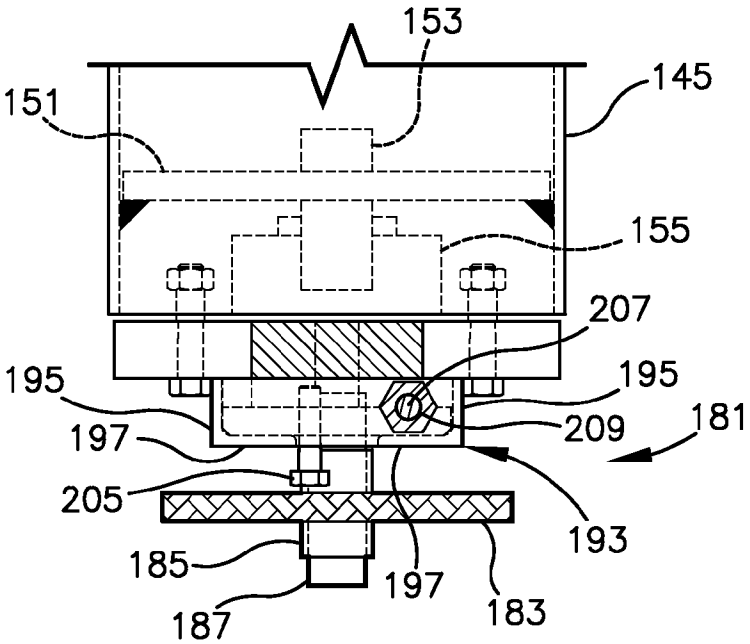
FIG. 12 is a fragmentary cross-sectional view of the end of the screed roller mounted on an idler mount with a riser wheel mounted thereto taken generally along line 12-12 of FIG. 11.
Figure 11:
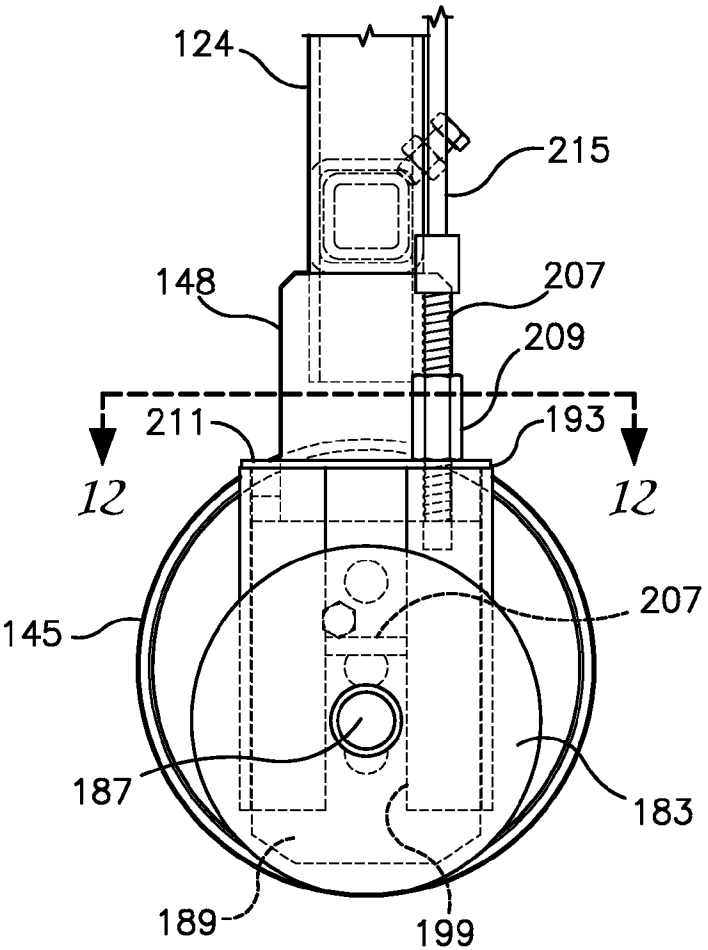
FIG. 11 is a fragmentary end view of a screed roller mounted on an idler mount and showing a riser wheel mounted thereto.
Figure 13:
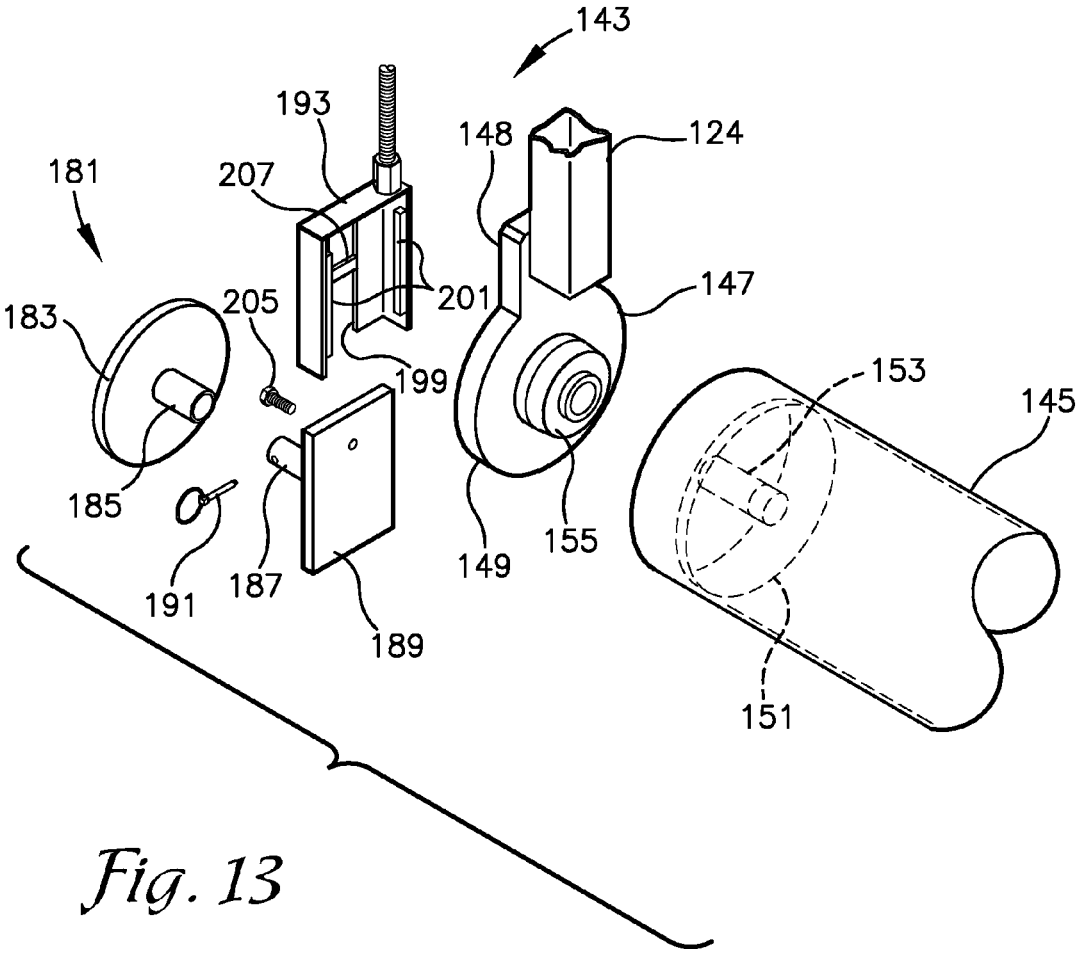
FIG. 13 is a fragmentary, exploded perspective view of an end of the screed roller mounted on an idler mount and the riser wheel mounted thereto.

Referring to FIGS. 8 and 9, the longitudinal support member 133 extends between lower ends of the inner vertical tubes 124 of each pair of vertical supports 105 and 107 associated with each screed roller 32 or 33. Each longitudinal support member 133 is formed from square tubing and is supported on square mounting studs 135 projecting inward from the lower end of each inner vertical tube 124. Longitudinal support members 133 of differing length may be used depending on the length of the rollers 32 or 33 used. The longitudinal support member 133 may be secured to the mounting studs with set screws 137 or other acceptable fastening means. It is to be understood that when the vertically telescoping roller supports 105 and 107 connected to opposite ends of screed rollers 32 and 33 are raised or lowered to different extents, there is sufficient play between the longitudinal support members 133 and the mounting studs 135 on the vertical tubes 124 of roller supports 105 and 107 to permit the screed roller 32 or 33 to extend at an angle.

Supported on the end of each screw jack 105 and 107 is either a roller drive assembly 141 or a roller idler assembly 143 rotatably supporting a screed roller tube 145 therebetween. The roller idler assembly 143 includes a paddle shaped idler mount 147 fixedly connected to and extending downward from a lower end of the inner vertical tube 124 of one of the vertical roller supports 105 or 107. The idler mount 147 includes a narrow stem 148 projecting upward from a circular mounting disc 149 which has a diameter which closely approximates but is slightly smaller than the diameter of the roller tube 145. A hub or idler shaft mounting plate 151 is welded within the tube 145 recessed inward from an end of tube 145 closest to the idler mount 147. An idler shaft 153 is welded to or otherwise fixedly connected to the center of the idler shaft mounting plate 151 to project outward towards the open end of roller tube 145 adjacent the idler mount 147. The distal end of the idler shaft 153 is received in and rotatable supported by an idler bearing assembly 155 mounted on an inner surface of the circular mounting disc 149 of the idler mount 147. The roller tube 145 is axially aligned with a center of the circular mounting disc 149 of the idler mount 147

The roller drive assembly 141 includes a paddle shaped drive assembly mount 159 fixedly connected to and extending downward from a lower end of the inner vertical tube 124 of one of the vertical roller supports 105 or 107. The drive assembly mount 159 includes a narrow stem 160 projecting upward from a circular mounting disc 161 which has a diameter which closely approximates but is slightly smaller than the diameter of the roller tube 145. A hub or drive axle mounting plate 163 is welded to or otherwise fixedly secured within the roller tube 149 in inwardly space relation to the end of the roller tube 149 proximate the drive assembly mount 159. A slotted, tubular stub axle 165 is fixedly secured to and projects outward from a center of the drive stem mounting plate 163.

A drive motor 167 mounted within a motor housing 169 mounted within the roller tube 145 is used to drive the roller tube 145. The motor housing 169 is fixedly mounted to a motor housing mount 171 which is bolted to an inner face of the mounting disc 161 of the drive assembly mount 159. The motor housing 169 preferably extends completely within the end of the roller tube 145. The motor housing 169 comprises a U-shaped wall which restrains the motor 167 positioned therein from rotating. A drive shaft bearing assembly 173 is mounted on an inner end of the motor housing 160 in relatively closely spaced relation to the drive axle mounting plate 163. A drive shaft 176 extends from motor 167 at least partially through drive shaft bearing assembly 173 and into keyed and driving engagement with the tubular stub axle 165 projecting outward from the drive axle mounting plate or hub 163. The tubular stub axle 165 also extends through and is rotatably supported in the drive shaft bearing assembly 173. Rotation of the motor drive shaft 176 by motor 167 rotates the stub axle 165 which rotates the roller tube 145 connected thereto.

The drive motor 167 is preferably completely positioned within an end of the roller tube 145 which reduces the overall length of the screed rollers 32 and 33 and reduces the likelihood of damage to the motors 167 or the motor shafts 173. Because the drive motor 167 is mounted completely within the roller tube 145 the roller drive assembly 141 can be positioned on either end of the screed roller 32 or 33. For example, in the embodiment shown, the roller drive assembly 141 for the first or inner screed roller 32 is connected to the rear vertical roller support 107 and the roller drive assembly 141 for the second our outer screed roller 32 is shown connected to the front vertical roller support 105.

A vertical spacing assembly 181 is mounted on the ends of each screed roller 32 and 33 and more specifically on each of the idler mounts 147 of the roller idler assemblies 143 or on the drive assembly mounts 159 of the roller drive assemblies 141 with the vertical spacing assembly 181 projecting outward therefrom. The vertical spacing assemblies 181 are adapted for supporting the screed roller in spaced relation above the slab 2 adjacent the hole 15 in which the uncured concrete is to be leveled and finished so that the ends of the roller tube 145 extending over the slab 2 on opposite sides of the hole 15 do not contact the hardened slab 2 thereby reducing wear on the tube 145. Finishing the concrete to a height slightly higher than the level of the surrounding slab 2 is advantageous because the concrete shrinks as it cures resulting in an smoother transition between the patch and the surrounding slab 2.

Each vertical spacing assembly 181 in the embodiment shown includes a riser wheel or roller support wheel 183 mounted on a tubular hub 185. The tubular hub 185 is rotatably mounted on a cylindrical stub axle 187 which is secured to and projects horizontally outward from a sliding mounting plate or slide plate 189. Slide plate 189 may also be referred to as a roller support wheel mount. A cotter pin 191 or the like may be used to prevent the riser wheel 183 from coming off the stub axle 187. As used herein, the roller support wheels 183 may take the form of cylindrical or spherical shaped rollers.

The slide plate 189 is slidably mounted within a slotted receiver 193. A slotted receiver 193 is mounted on or formed on an outer surface of each of the idler mounts 147 or drive assembly mounts 159 in vertical alignment with a central vertical axis of the mounts 147 and 159. Each slotted receiver 193 is formed from a pair of angle irons welded to the mount 147 or 159 to form sidewalls 195 projecting outward therefrom with inwardly facing front flanges 197 which extend inward toward each other from outer ends of the sidewalls 157. A slot 199 is formed between inner edges of the flanges 197 and is sized wide enough to allow the stub axle 187 to pass therethrough.

Spacers 201 formed from a strip of metal having a square cross-section welded to the mounts 147 and 159 behind the front flanges 197 form channels 203 with the front flanges 197 in which outer edges of the slide plate 189 are received and slide. The slide plate 189 is captured between the front flanges 197 and the 201 with the stub axle 187 extending through the slot 199 between font flanges 197. The slide plate 189 slides vertically relative to the slotted receiver 193. The bottom or the receiver 193 is generally open so that a bottom edge of the slide plate 189 may slide past the bottom of the receiver 193. A stop bolt 205 is secured to and projects outward from the slide plate 189 in alignment with the slot 199. A stop bar 207 extends across the slot 199 spanning inward facing edges of the front flanges 197. Abutment of the stop bolt 205 against the stop bar 207 prevents the slide plate 189 from sliding completely out the bottom of the receiver 193. The stub axle 187 extends below the stop bar 207 and the stop bar is positioned so that the stub axle 187 does not engage the stop bar 207 until the slide plate 189 slides high enough in the receiver 193 such that a lower periphery of the riser wheel 183 is at least even with and not spaced below a lower periphery of the roller tube 145.

The riser wheel 183 has an outer diameter that is either equal to or less than the diameter of the roller tube 145 to which it is connected. In the embodiment shown, the stub axle 165 slides vertically in slot 199 and along a vertical axis extending through the axis of rotation of the roller tube 145 such that the axis of rotation of the riser wheels 183 connected to the roller tube 145 are maintained in a common vertical plane. The axis of rotation of the riser wheels or roller support wheels 183 may be aligned with the axis of rotation of the roller tube 145 or extend in parallel spaced relation above or below the roller tube axis of rotation. It is also for seen that the axis of rotation of each of the roller support wheels 183 may be offset to either side of the axis of rotation of the roller tube. It is preferable to maintain the axis of rotation of each roller support wheel 183 in a common vertical plane with the axis of rotation of the roller tube 145 so that the roller tube 145 follows the contours of the surrounding slab 2 over which the roller support wheels 183 travel.

Adjustments to the positioning of the axis of rotation of each riser wheel 183 to the axis of rotation of the roller tube 145 to adjust the height the riser wheels 183 space the roller tube 145 over a surface on which the riser wheels 183 are supported is controlled using a height adjustment bolt 207 extending through a threaded receiver 209 mounted on a top plate 211 for the slide plate receiver 193. A distal end of the height adjustment bolt 207 extends through the threaded receiver 209 and the top plate 207 and into the space in which the slide plate 189 carrying the stub axle 165 for riser wheel 183 is allowed to slide. Advancement of the distal end of the height adjustment bolt 207 further past the top plate 211 increases the spacing between the lower edge of the riser wheel 183 and the lower edge of the roller tube 145 when the slide plate 189 is retracted within the slotted receiver 193 to the point at which it engages the height adjustment bolt 207.

The height adjustment bolt 209 for each vertical spacing assembly 181 is connected to a height adjustment drive motor 213 mounted on the concrete finishing machine 21, and preferably on the screw jack mounting assembly 110 for the vertical roller support 105 or 105' associated therewith (see FIGS. 15 and 16). The connection between the height adjustment drive motor 213 and the height adjustment bolt 209 is preferably through a flexible drive shaft 215.

It is foreseen that the roller support wheels 183 could be mounted relative to the roller tube 145 so that a lower periphery of the roller support wheel 183 is spaced above a lower edge of the roller tube 145 and with the roller support wheels 183 traveling on tracks, rails or vertical spacers extending along and adjacent the hole 15 or mass of concrete to be leveled. The roller tube 145 can then be used to level and finish the uncured concrete to a level which is below an upper surface of the tracks, rails or spacers and which may be at the same level as the surrounding slab or below or above the level of the surrounding slab.

The vibrator assemblies 31, which are of a commercially available design, are mounted on a vibrator support beam 221 which is connected to the outer tube 99 of the horizontally telescoping vibrator support 87 by a pair of vertically telescoping vibrator supports or screw jacks 223 which are of the same construction as the screw jacks 105' supporting screed rollers 32 and 33. The screw jacks 223 are connected to the outer tube 99 by mounting assemblies 225 which are of similar construction as the mounting assemblies 110 connecting screw jacks 105' to outer tube 93 and which permit pivoting of the vibrator support beam 221 from front to back of the finishing machine 21. Referring to FIGS. 2,4 and 7, the vibrator support beam 221 is connected to the lower ends of the inner telescoping tubes 227 of the screw jacks 223 by lateral spacers 229 connected to tubes 227 and vertically oriented support legs 231 connected to the spacers 229.

The screw jacks 223 can be extended or retracted to lower or raise the heads 233 of vibrators 34 into and out of a hole 15 filled with unfinished concrete. When lowered into unfinished concrete, the vibrators 34 operate in a conventional matter to increase the fluidity of the concrete to cause it to tend to flow into the unoccupied portions of the hole 15 and so that gravity will generally pull the fluidized concrete to a generally level condition.

First and second sprayers or spray nozzle assemblies 235 and 237 are mounted on the outer tubes 99 and 93 of the longitudinally telescoping vibrator support 87 and the longitudinally telescoping outer roller support 86 respectively. Each sprayer 235 and 237 includes a manifold 239 connected to outer tubes 99 and 93 respectively and a plurality of nozzles 241 flow connected to the manifold 239. Manifold 239 for sprayer 235 is connected by a cure tank supply line or pipe (not shown) to a cure tank 243 which contains a supply of a curing solution. A pump (not shown) connected to the cure tank supply line pumps curing solution through the manifold 239 and out nozzles 241 as requested to spray the curing solution on the uncured concrete in the hole 15 to expedite the curing process.

Manifold 239 for sprayer 237 is connected by a pre-cure tank supply line or pipe (not shown) to a pre-cure tank 245 which contains a supply of a pre-cure solution. A pump (not shown) connected to the pre-cure tank supply line pumps a pre-cure solution through the manifold 239 and out nozzles 241 as requested to spray the pre-cure solution on the uncured concrete in the hole 15. The pre-cure solution wets the uncured concrete to facilitate finishing thereof including facilitating vibrating and rolling. The cure tank 243 and pre-cure tank 245 are both mounted on the base frame or chassis 23.

An alternative embodiment of a finisher assembly 251, is shown in FIGS. 17-20 and includes a vibrator support assembly 253 which slides longitudinally to permit vibrators 233 supported thereon to be moved to different longitudinal positions within the hole 15 containing concrete to be finished without having to move the finishing machine 21. Finisher assembly 251 includes first and second telescoping longitudinal roller support assemblies 85 and 86 similar in construction to those of assembly 35 pivotally attached to front and rear laterally telescoping support members 81 and 82. Instead of supporting the vibrators 233 from a third telescoping support 87, in finisher assembly 251, the vibrator support assembly 253 is slidingly mounted to the outer tube 93 of the second our outer longitudinally telescoping roller support 86.

The vibrator support assembly 253 includes a sliding support tube or base 255, slidingly mounted around outer tube 93 of roller support 86. A chain and sprocket assembly 257 mounted on the inner side of the outer tube 93 of roller support 86 is connected to the sliding support tube 255 for sliding the support tube 255 along outer tube 93. Opposite ends of a chain 258 are connected to the sliding support tube 255 and the chain 258 loops around a drive sprocket 261 and an idler sprocket 262 mounted near opposite ends of outer tube 93. The drive sprocket 262 is driven by a motor 264 connected to a distal end of the outer tube 93 of roller support 86. A tensioner 266 is connected to the idler sprocket 262 for adjusting tension on the chain 258. Rollers or cylindrical bearings 268 may be mounted to the sliding support tube 255 and extend through openings therein to engage the outer tube 93 to facilitate sliding movement of the sliding support tube 255 relative to the outer tube 93.

A laterally telescoping vibrator support 271, including an outer tube 272 and inner tube 273 is connected to and supported below the sliding support tube 255. More specifically the outer tube 272 is connected to sliding support tube 255 and projects perpendicular thereto and the inner tube 273 is secured within outer tube 272 and projects laterally outward therefrom. The position of inner tube 273 relative to outer tube 272 may be fixed by set screws or the like. A vertically telescoping vibrator support 275 is connected to the outer end of the inner tube 273 of laterally telescoping vibrator support 271. The vertically telescoping vibrator support 271 includes a vertically oriented mounting sleeve 276 welded to or otherwise connected to the outer end of inner tube 273 of the laterally telescoping vibrator support 271. An outer telescoping tube 277 is slidably mounted within mounting sleeve 276 and an inner telescoping tube 278 is slidably mounted within outer telescoping tube 277. A hydraulic actuator 279 is positioned within and connected between the outer and inner telescoping tubes 277 and 278 for use in extending and retracting inner tube 277 relative to outer tube 278. Set screws 280 extending through the sleeve 276 may be used to fix the position of the outer telescoping tube 277 relative to the sleeve 276 to permit additional adjustments to the height of the vibrators 34 relative to the finisher support frame 27.

It is also understood that vertically telescoping vibrator support may be constructed similar to vertically telescoping vibrator support 223 using a jack screw instead of a hydraulic actuator. Similarly, the jack screws shown for controlling the vertical positioning of the rollers and the vibratos may be replaced with telescoping assemblies using hydraulic actuators or other types of linear actuators.

A vibrator support beam 282 is mounted on and projects longitudinally relative to the vertical telescoping vibrator support 275. In the embodiment shown, the vibrator support beam 282 most of the vibrator support beam extends to one side of the vertical telescoping vibrator support 275. In the embodiment shown, most of the vibrator support beam 282 extends toward the front end of the finishing machine 21. Three vibrators 34 are then mounted to the vibrator support beam 282 in spaced alignment with a head 233 of each vibrator 34 extending below the support beam 282. The longitudinal spacing between each vibrator 34 on the support beam 282 is preferably adjustable. In a typical configuration, the vibrators may be spaced approximately two to three feet apart.

Figure 20:
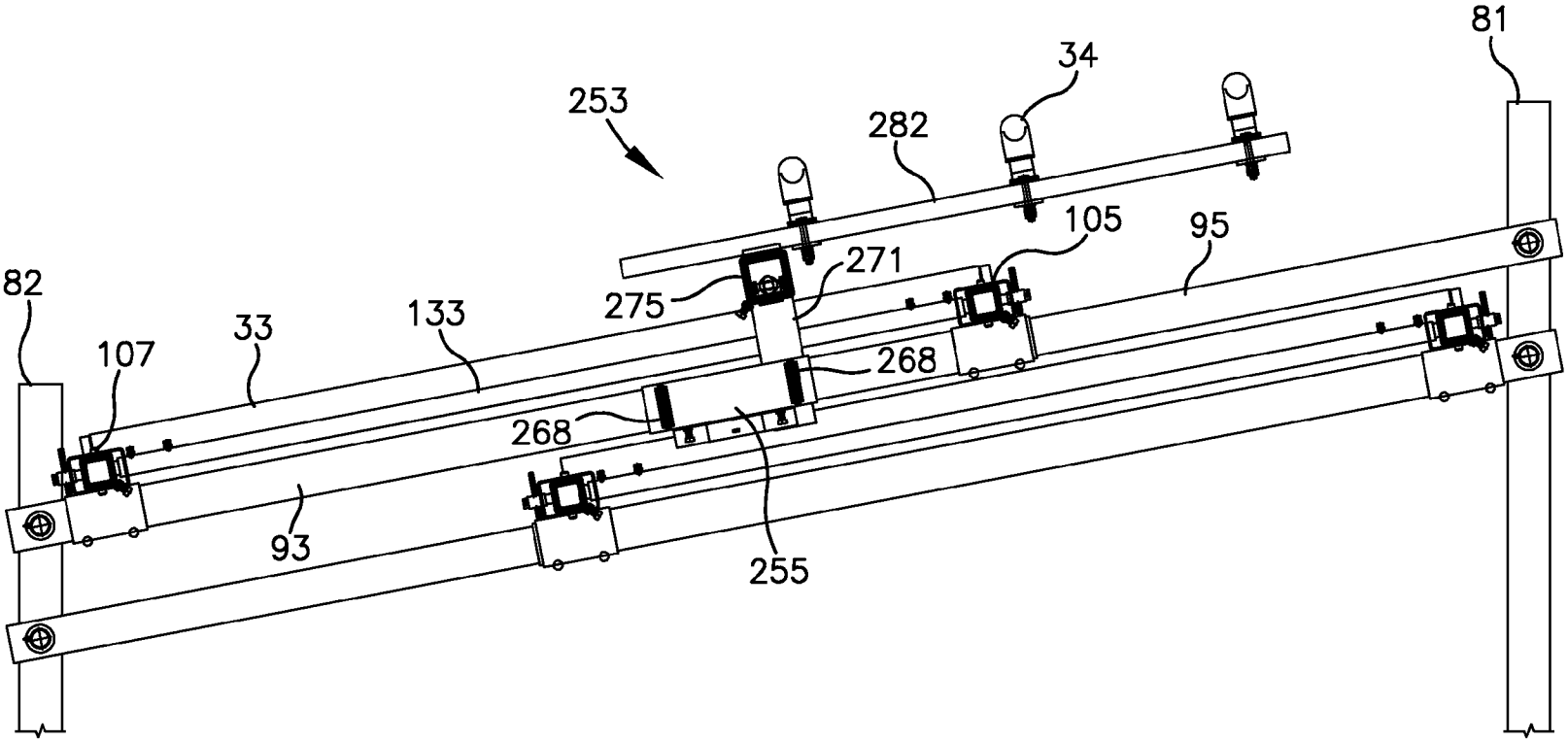
FIG. 20 is a fragmentary view similar to FIG. 17 showing the finisher assembly in an expanded and angled configuration.

When the chassis 23 and the alternative finisher assembly 251 are in a longitudinally retracted configuration for finishing concrete in a hole six feet or more across, vibrator support assembly 253 is slid toward the rear end of the outer tube 93 of longitudinally telescoping outer roller support 86. When the chassis 23 and alternative finisher assembly 251 are expanded longitudinally, as shown in FIG. 20, the vibrator support assembly 253 the motor 264 connected to chain and sprocket assembly 257 is activated to slide the vibrator support assembly 253 along the outer tube 93 of roller support 86 toward the front or inner end thereof to advance the vibrator support beam 282 and vibrators 34 attached thereto generally longitudinally relative to the expanded concrete finishing machine 21 including toward the front end thereof to allow the vibrators 34 to be positioned in different longitudinal positions relative to uncured concrete placed in a hole 15 straddled by the expanded finishing machine 21.

Figure 21:
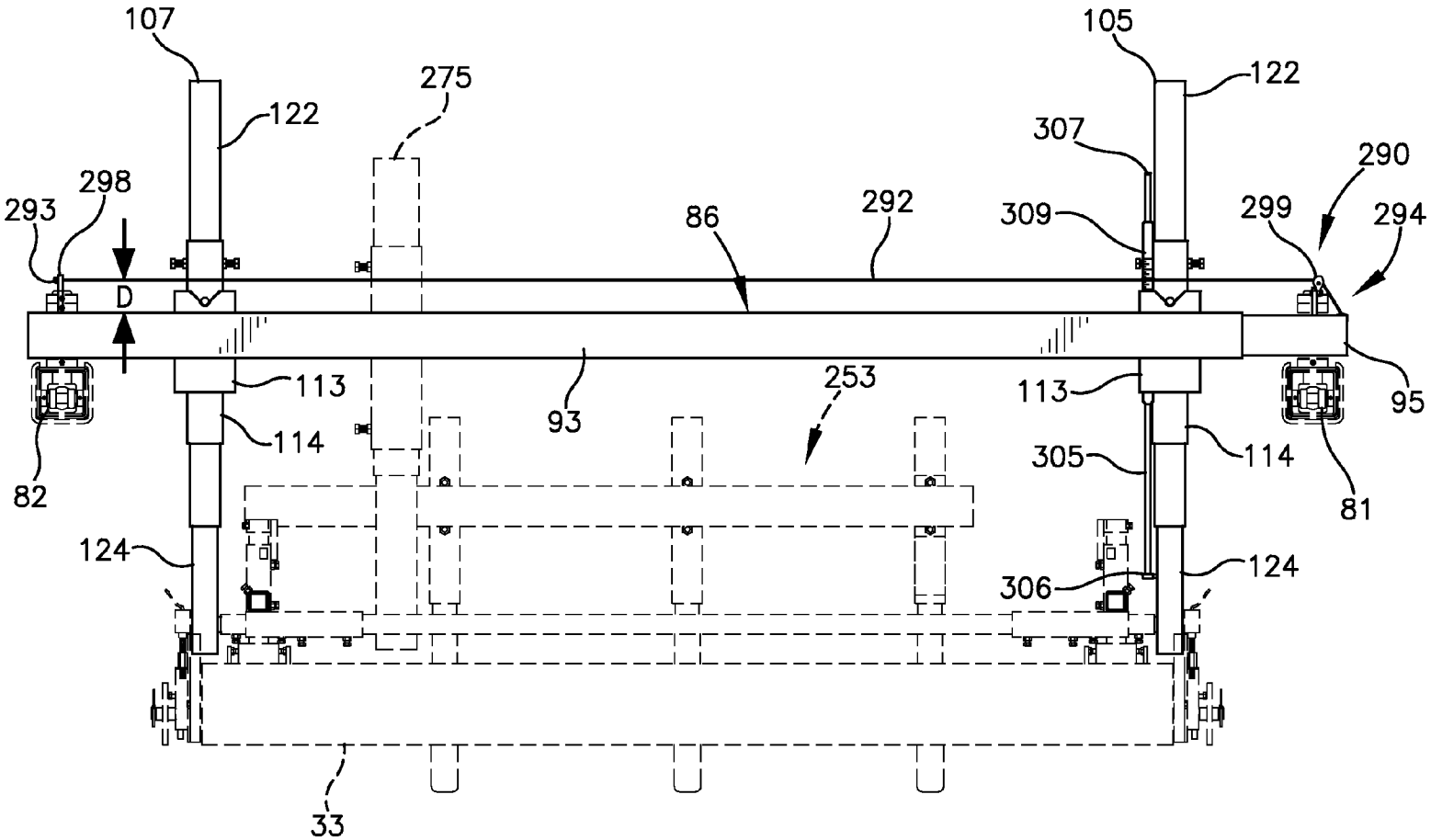
FIG. 21 is a cross-sectional view of the finisher assembly similar to FIG. 18 with portions removed or shown in phantom lines for clarity and showing a roller leveling guide attached to a longitudinally telescoping roller support member in a retracted position.
Figure 22:
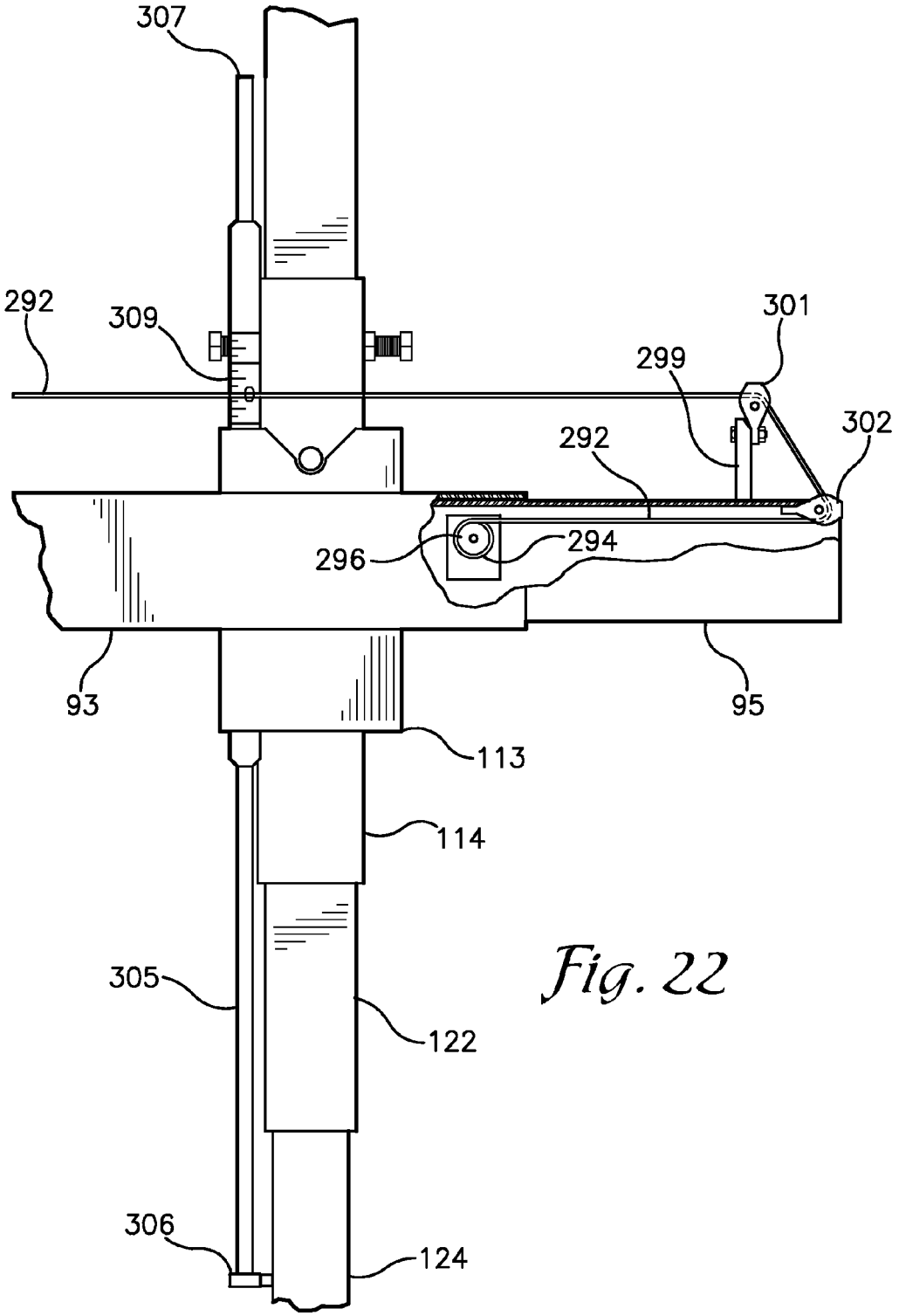
FIG. 22 is an enlarged and fragmentary view of the finisher assembly as shown in FIG. 21 with portions removed to show detail of the roller leveling guide.
Figure 23:
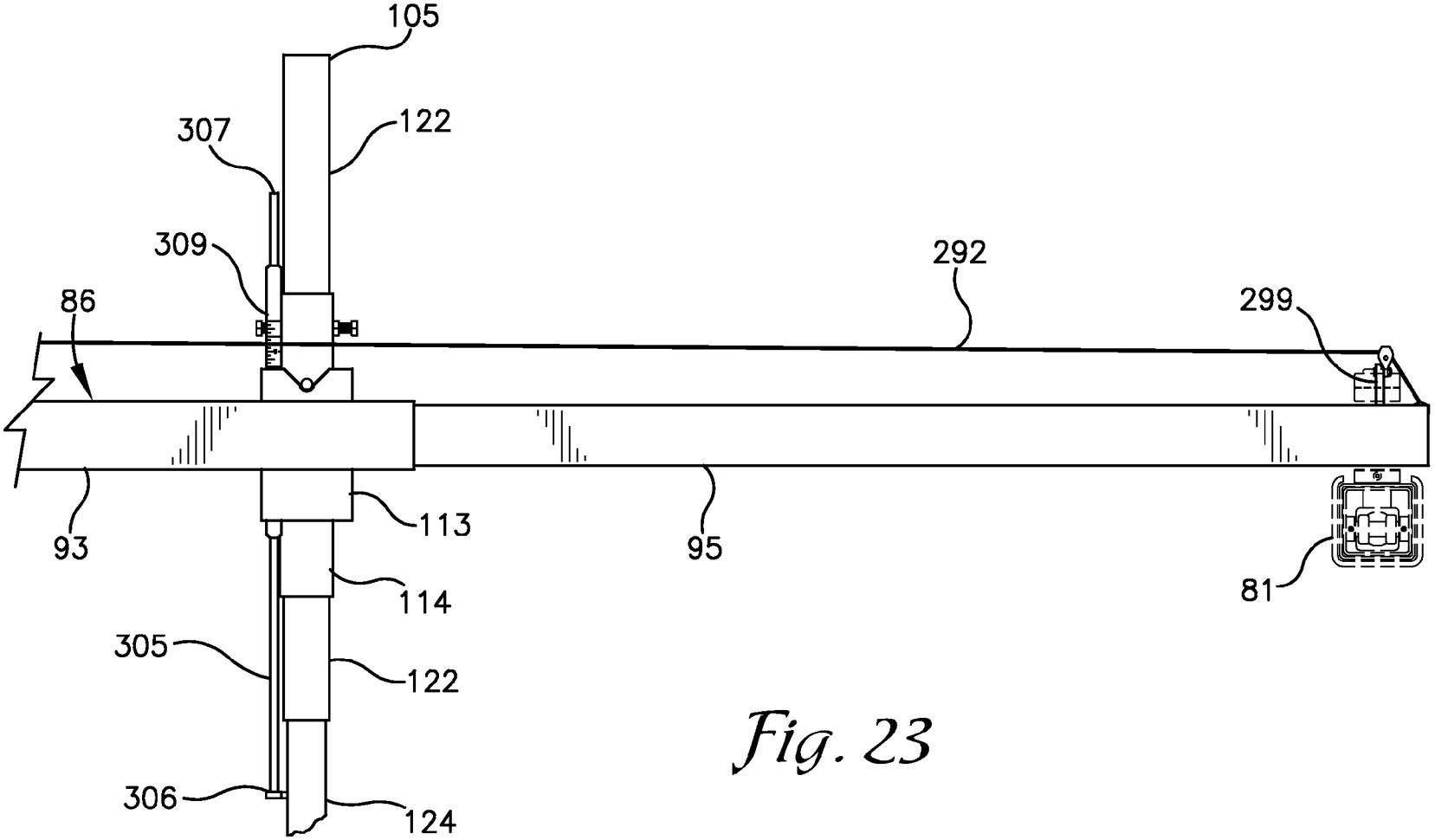
FIG. 23 is an enlarged and fragmentary view of the finisher assembly as shown in FIG. 21 showing the longitudinally telescoping roller support member and a roller leveling guide attached thereto in an extended position.

Referring to FIG. 17, a roller leveling guide 290 is shown mounted on each of the longitudinally telescoping roller supports. FIGS. 21 through 23 provide additional details of the roller leveling guide 290 connected to the outer longitudinally telescoping roller support 86. Roller leveling guide 290 mounted on inner longitudinally telescoping roller support 85 is constructed and operates similarly.

When the finisher assembly 35 is expanded over a hole 15 filled with uncured concrete, the outer ends of inner and outer tubes 91 and 93 remain at a generally fixed height because they are supported on the front and rear laterally telescoping support members 81 and 82 which are supported over the front and rear wheels 25 and 26 of the chassis 23 which are supported on the concrete slab 2 adjacent the hole 15. However, when the inner ends of the outer tubes 93 of the inner and outer telescoping roller supports 85 and 86 are pulled away from respective front and rear laterally telescoping support members 81 and 82, the weight of the vertical roller supports 105 and 107 and the associated rollers 32 and 33 supported thereby pull down on the inner ends outer tubes 93 of inner and outer longitudinally telescoping roller supports 85 and 86 resulting in the rollers 32 and 33 sloping downward towards the center of the expanded finisher assembly 35.

The roller leveling guide 290 allows an operator to determine how much to retract the vertical roller supports 105 and 107 connected to the inner ends of outer tubes 93 to pull the inner ends of the rollers 32 and 33 to be level with the outer ends thereof. Alternatively, the leveling guide 290 may be used to determine how high to raise the inner ends of the rollers 32 and 33 above the outer ends thereof to create a crown in the uncured concrete poured in the hole 15 or to lower the inner ends of the rollers 32 and 33 to create a depression or trough in the uncured concrete.

The roller leveling guides 290 as shown attached to telescoping roller support 86 includes a generally inelastic cord or sting 292 fixedly connected at a first end 293 to an outer or distal end of the outer tube 93. A second end 294 of the cord 292 is wound around a spring loaded spool or reel 296 mounted within an outer or distal end of the inner tube 91 of the telescoping roller support 86. The first end 294 of cord 292 is connected to a first vertical cord support 298 and spaced a first distance D above outer tube 93 at an outer end thereof which is positioned over the rear laterally telescoping support member 82. A second vertical cord support 299 supports the cord 292 near its second end in spaced relation above the outer end of the inner tube 91 which is positioned above the front laterally telescoping support member 81. Second vertical cord support 299 supports the cord 292 at the same height or distance, distance D, above the outer end of the outer tube 93 as the first vertical support 298. The second vertical cord support 299 includes a first guide roller 301 around which the cord may slide or roll during expansion or contraction of the finisher assembly 35. A second guide roller 302 may be mounted on an open, outer end of the inner tube 91 over which the cord 292 may also slide or roll and around which the cord 292 is directed from off of the reel 296 and up to the second vertical cord support 299. As the finisher assembly 35 is expanded, additional cord 292 is pulled off of the reel 296 to span the increasing distance between the first and second vertical cord supports 298 and 299. Similarly, as the finisher assembly 35 is retracted, spring loaded reel 296 rotates to take up slack in cord 292 as the distance spanned by the cord 292 decreases.

A level indicating rod 305 is connected at a lower end 306 to the inner vertical tube 124 of the vertical support 105 or 107. The level indicating rod 305 is connected to the pivot sleeve 114 of the vertical support 105 or 107 near an upper end 307 thereof with the level indicating rod extending through the gap between the vertical mounting sleeve 113 and the pivot sleeve 114 of vertical support 105 or 107. A scale 309 with vertical increments is formed or mounted on the level indicating rod 305 near the upper end 307 thereof such that the cord 292 extends across the scale at an increment labeled zero and indicating a general level or horizontal alignment of the rollers 32 and 33 from one end to the other thereof.

Referring to FIG. 22, when the vertical support 105 pulls the outer tube 93 of telescoping roller support 86 downward upon expansion of the finisher assembly 35 as discussed previously, the level indicating rod 105 and scale 109 are also pulled downward. Similarly, vertical support 107 of telescoping roller support 85 will pull down on the outer tube 93 when the finisher assembly 35 is expanded. The distance the vertical support 105 and 107 droop downward is indicated by the number of increments on the scale 309 by which the zero increment is spaced below the cord 292. Retracting the inner vertical tubes 124 connected to the inner ends of rollers 32 and 33 until the zero increment on the scale 309 is brought back into alignment with the cord 292 will raise the inner ends of rollers 32 and 33 back to a level alignment with the outer ends of the rollers 32 and 33. Retracting the inner vertical tubes 124 further so that the zero increment of each level indicating rod 305 extends above the cord 292 by a selected number of increments will raise the inner ends of the rollers 32 and 33 relative to the outer ends thereof so that the rollers 32 and 33 slope downward from the center when the finisher assembly 35 is in an expanded alignment. Such downward and outwardly sloping rollers 32 and 33 may be used to form a crown in the finished concrete.

Figure 24:
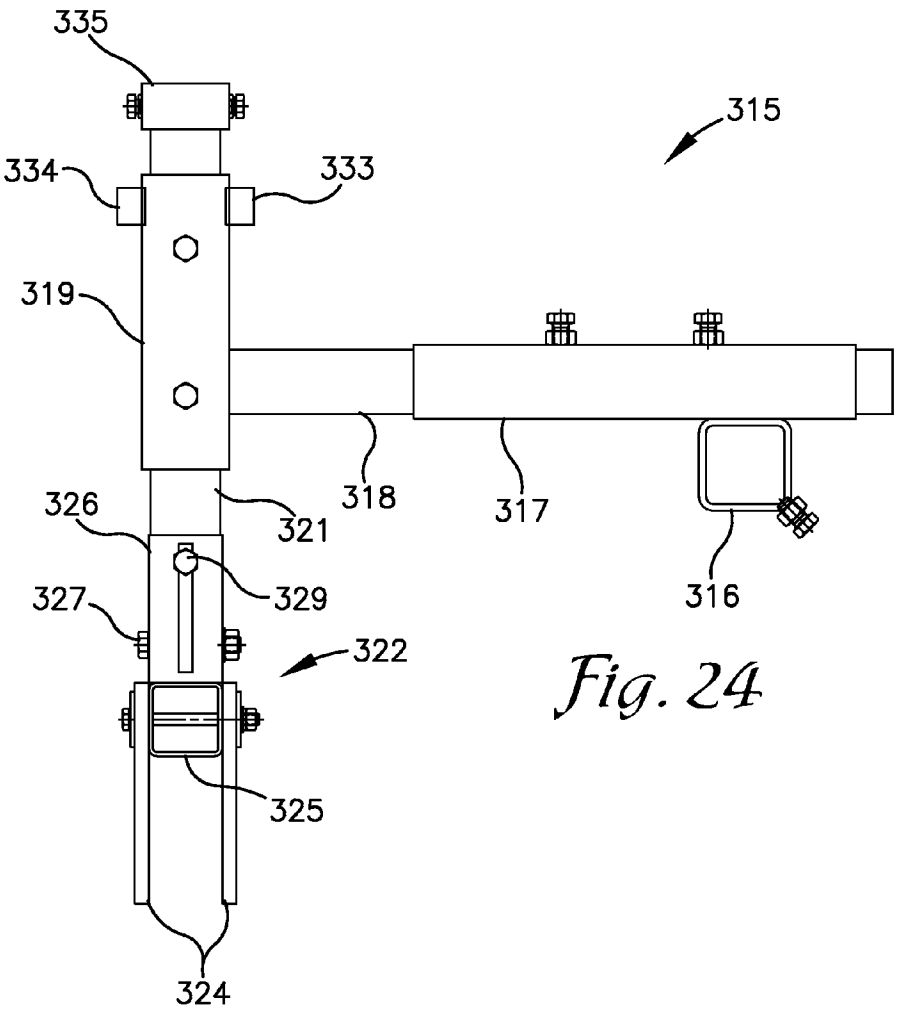
FIG. 24 is an enlarged side elevational view of a wiper assembly securable to the finisher assembly as shown in FIG. 17.
Figure 25:
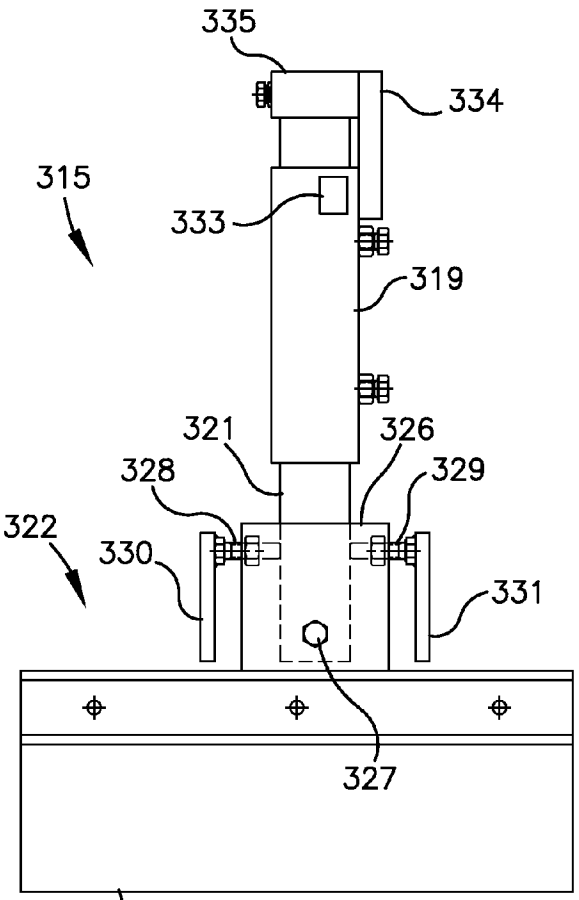
FIG. 25 is a front elevational view of the wiper assembly.
Figure 26:
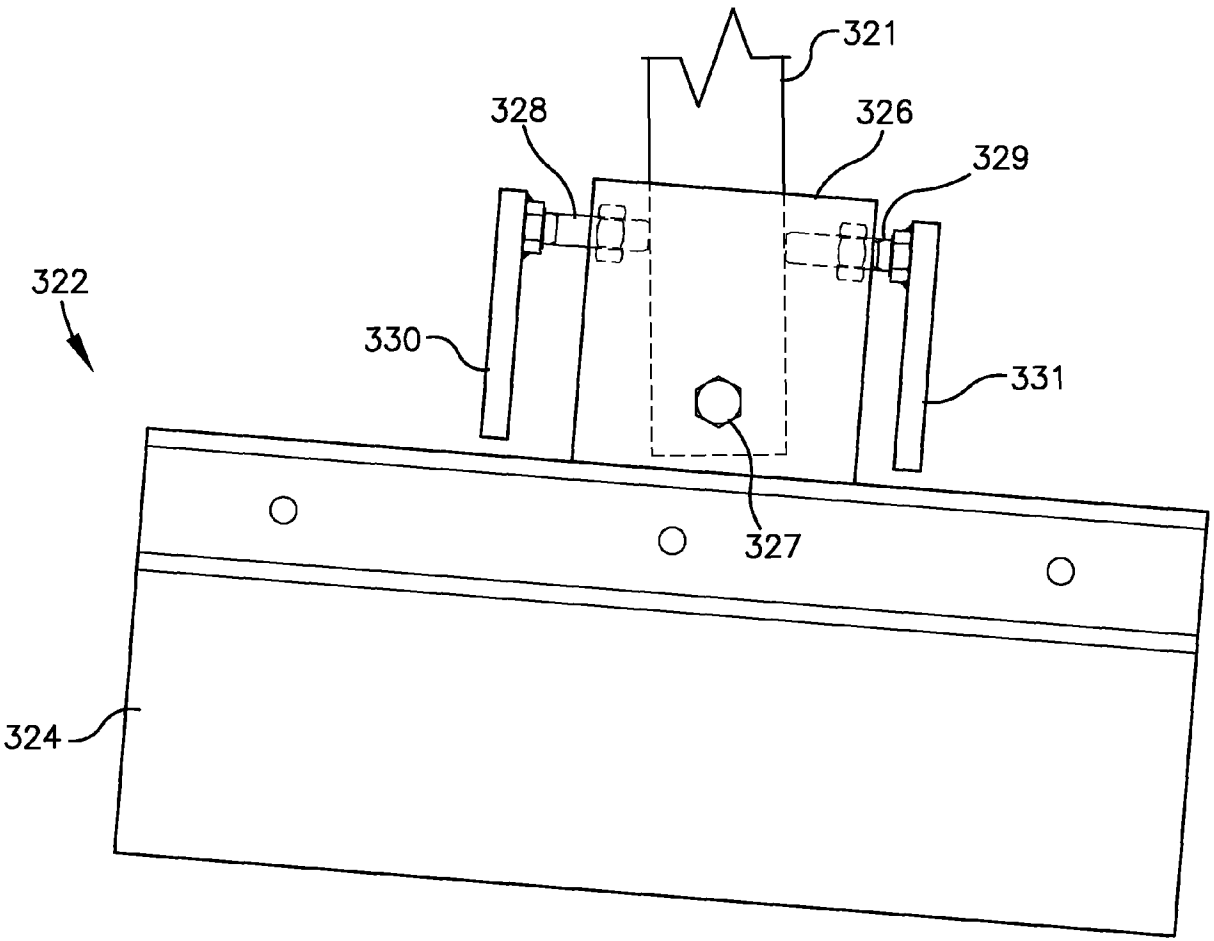
FIG. 26 is a fragmentary, front elevational view of the wiper assembly with a head pivoted relative to a pivot shaft on which the head is mounted.

Referring to FIGS. 17 and 18, a pair of wiper assemblies 315 are shown connected to the longitudinal support member 133 on opposite ends thereof. Additional details of the wiper assemblies 315 are shown in FIGS. 24 through 26. Each wiper assembly 315 includes a longitudinally sliding mounting sleeve 316 slidably mounted on the longitudinal support bar 133 extending between vertical roller supports 105 and 107. The position of the mounting sleeve 316 along the longitudinal support bar 133 is selectively fixed with set screws extending through the sleeve 316 and engaging the support bar 133. A laterally extending receiver 317 is connected to and extends perpendicular to the longitudinally sliding mounting sleeve 316. The laterally extending receiver 317 receives a stem 318 connected to and projecting outward from a vertically extending pivot sleeve 319. A wiper shaft 321 extends vertically through and is rotatably or pivotally secured within pivot sleeve 319. A wiper head 322 is pivotally connected to the wiper shaft 321 at a lower end thereof. Wiper head 322 includes a pair of flexible wiper blades 324 mounted on and projecting downward from a square tube or wiper head base 325.

A rectangular wiper head mounting sleeve 326 projects upward from the center of the wiper head base 325. A pivot pin 327 extends through and connects opposed sidewalls of the sleeve 326 to a lower end of the wiper shaft 321. The pivot pin 327 extends transverse to the generally vertically extending plane occupied by the wiper blades 324 so that the wiper blades 324 may pivot from side to side within that vertical plane. Set screws 328 and 329 threaded through the end walls of the wiper head mounting sleeve 326 engage the wiper shaft 321 on opposite sides of the shaft 321 and above the pivot pin 327. Backing one set screw, such as set screw 328 in FIG. 26, away from the wiper shaft 321, while advancing the other set screw, i.e. set screw 329, toward the wiper shaft 321 causes the wiper head 322 to pivot about pivot pin 327. Weighted handles 330 and 331 project to one side of the set screw head and will normally rotate downward to prevent the set screws 328 and 329 from vibrating out of the threaded receivers in which they are received.

The longitudinal position of the wiper assemblies 315 relative to the longitudinal support bar 133 is adjustable by sliding mounting sleeves 316 over support bar 133 to permit positioning of the wiper members or blades 324 over opposite edges of the slab 2 adjacent the hole 15 filled with uncured concrete. Each wiper blade 324 is preferably positioned so that a portion of the wiper blade 324 extends over the hole 15. It is to be understood that longitudinal supports other than the support bar 133 could be used to support the wiper assemblies 315 and a separate longitudinal support could be provided for each wiper assembly 315. The wiper assemblies 315 can be rotated about wiper shaft 321 extending through vertical pivot sleeve 319 to angle the blades 324 at an angle from approximately thirty to sixty degrees relative to the respective edge of the hole 15 spanned by the roller 32 when finishing concrete placed in the hole 15. The angular orientation of the blades 324 about the vertical axis of wiper shaft 321 is adjusted so that the wiper assemblies 315 on opposite ends of the roller 32 angle outward relative to the direction of movement of the roller 32. As the roller 32 moves over or across the hole 15 with uncured concrete therein, the outwardly angled wiper blades 324 function to push uncured concrete spilled on the slab surrounding the hole 15 back into the hole 15. The wiper heads 322 and attached blades 324 may be pivoted about pivot pin 327 so that the ends of the blades 324 over the hole 15 are angled upward relative to the ends of the blades 324 over the slab and outside of the hole 15 so that the wiper blades 324 do not remove uncured concrete from the hole 15.

Stops 333 formed on the vertical pivot sleeve 219 are engaged by a projection or leg 334 depending downward from a collar 335 mounted on the upper end of the wiper shaft 321 to limit the range of motion of the wiper head to approximately one hundred and eighty degrees. A lock pin (not shown) extending through the pivot sleeve 219 and wiper shaft 321 or through structure thereon may be used to lock the angular orientation of the wiper head 322 relative to the pivot sleeve 219. It is also foreseen that a hydraulic motor or other actuating means (not shown) acting on the wiper shaft 321 could be used could be used to control the angular orientation of the wiper head 322 relative to the pivot sleeve 219.

The length of wiper shaft 321 between the collar 335 and the mounting sleeve 326 is greater than the length of the pivot sleeve 319 and the wiper shaft 321 slides freely within the pivot sleeve 319 between the collar 335 and the mounting sleeve 326. The pivot sleeve 319 is supported above the slab 2 from the longitudinal support bar 133 such that a lower edge of the wiper members or blades 324 rests on the slab 2 with the collar 335 on the wiper shaft 321 spaced above an upper end of the sleeve 319 and an upper edge of the wiper head mounting sleeve 326 spaced below a lower end of the sleeve 319 so that the wiper blade 324 will follow the contours of the slab 2 In the embodiment shown the collar 335 is normally spaced one to two inches above the pivot sleeve 319 and the wiper head mounting sleeve 326 is normally spaced one to two inches below the pivot sleeve 319.

Figure 27:
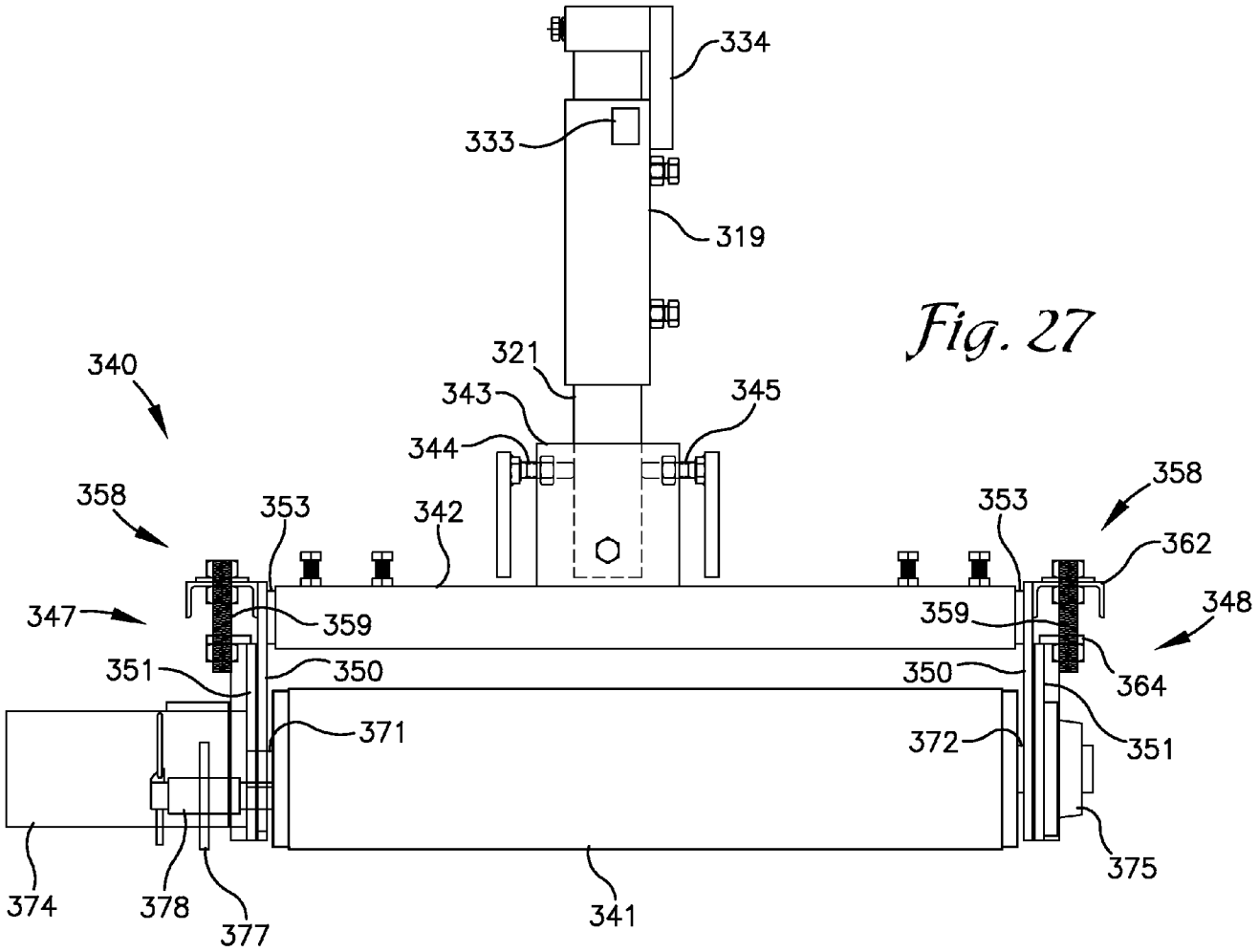
FIG. 27 is a front elevational view of a roller assembly that may be substituted for the wiper assembly.

FIG. 27 shows a wiper head 340 which may be used in place of wiper head 322. Wiper head 340 includes and uses a cylindrical roller 341 as the wiper member instead of wiper blades 324. Roller 341 is suspended from a longitudinal support beam or bar 342 from which a mounting sleeve 343 projects on a side opposite the roller 341. The mounting sleeve 343 is constructed similar to mounting sleeve 326 of wiper head 322 and is used to pivotally connect the wiper head 340 to a wiper shaft 321. Mounting sleeve 343 also includes set screws 344 and 345 for adjusting the angular orientation of the wiper head 340 about pivot pin 327 in the same manner set screws 328 and 329 are used to adjust the angular orientation of wiper head 322 about pivot pin 327.

Figure 28:
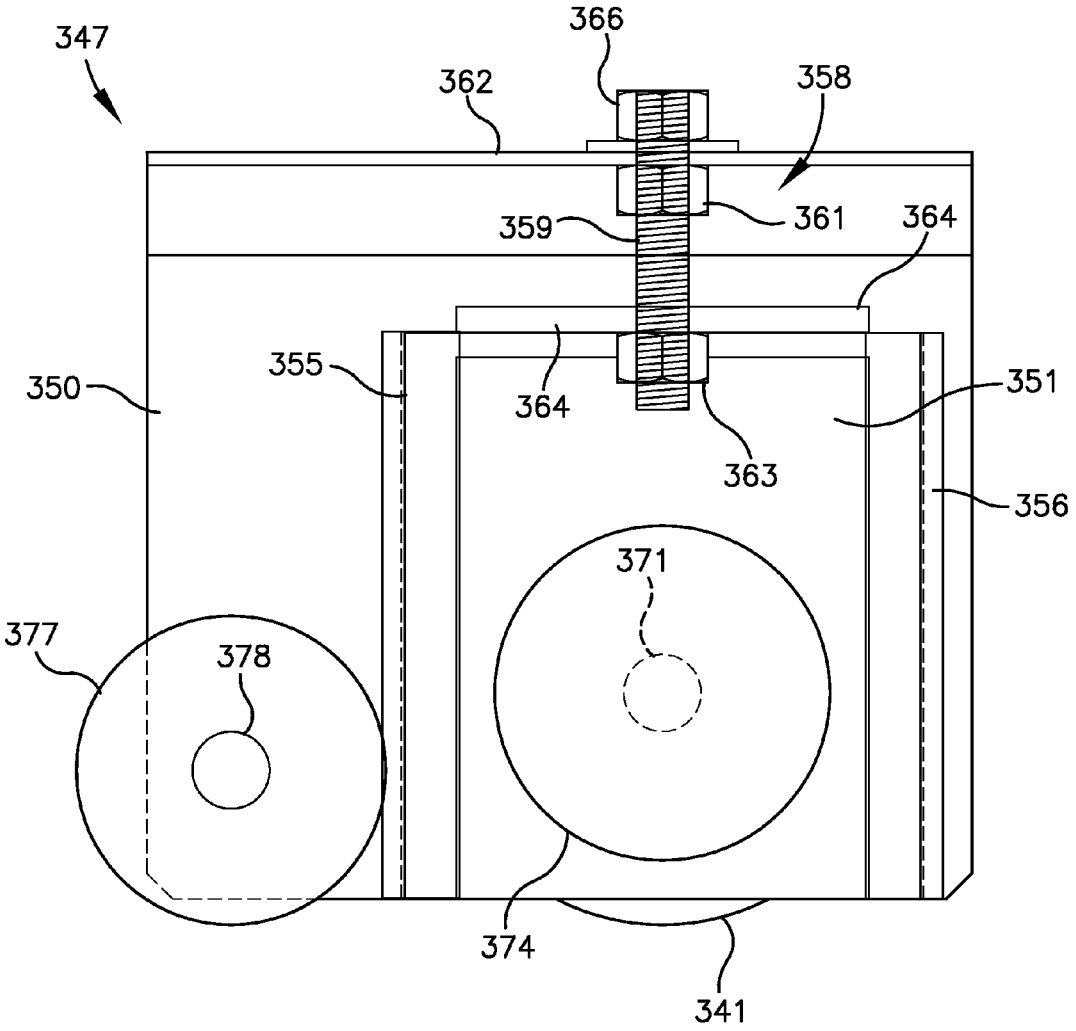
FIG. 28 is a left side elevational view of the roller assembly as shown in FIG. 27.

The roller 341 is suspended below the support bar 342 by height adjustable vertical supports 347 and 348. An end view or left side elevational view of vertical support 347 is shown in FIG. 28. Each vertical support includes a base plate 350 and an axle support plate 351 slidably mounted to an outer face of the base plate 350. The base plate 350 includes a stem 353 projecting from an inner face and near an upper end of the base plate 350 which is removably securable within an end of the support bar 342. A vertically oriented axle receiving slot (not shown) is formed through the base plate 350. A pair of guide members 355 extend vertically across the outer surface of each base plate 350 in spaced apart relation on either side of the axle receiving slot and define inwardly facing channels 356 for receiving outer edges of the axle support plate 351. The axle support plate 351 is held against the outer surface of the base plate 350 by guide members 355.

The vertical position of the axle support plate 351 relative to the base plate 350 is adjustable with height adjustment assembly 358. Height adjustment assembly 358 includes a bolt 359 projecting through a threaded receiver 361 formed on a flange 362 projecting outward from an upper end of the base plate 350 and through a threaded receiver 363 formed on a flange 364 projecting outward from an upper end of the axle support plate 351. A head 366 of the bolt 359 abuts an upper surface of the base plate flange 362 such that when the bolt 359 is rotated in a first direction, the threaded receiver 363 on axle support plate 351 is drawn upward drawing the axle support plate 351 upward relative to the base plate 350. Rotating the bolt 359 in a second direction advances the axle support plate 351 downward relative to the base plate 350.

Stub axles 371 and 372 projecting outward from opposite ends of the roller 341 extend through holes in the axle support plates 351 of vertical supports 347 and 348 respectively. A hydraulic motor 374 is mounted on an outer face of axle support plate 351 of vertical support 347 and drivingly coupled to stub axle 371. The motor 374 is operated to rotate the wiper roller 341 so that an upper edge of roller 341 is rotating away from the hole 15 and a lower edge is rotating toward the hole 15 to push or sweep any uncured concrete back into the hole 15. A bearing 375 is mounted on an outer face of axle support plate 351 of vertical support 348 and rotatably supports the stub axle 372. Adjustments to the vertical position of the axle support plates 351 of vertical supports 347 and 348 adjusts the vertical position of roller 341 relative to the roller support bar 342. The roller 341 is positioned relative to the support bar 342 so that a lower edge of the roller extends below a lower edge of the vertical supports 347 and 348 including below each of the base plates 350. A spacer wheel 377 is also shown mounted on base plate 350 of the vertical support 347 supporting the hydraulic motor 374. The spacer wheel 377 is rotatably supported on a stub axle projecting outward from the base plate 350. A lower edge of the spacer wheel 377 extends a set distance below the lower edge of the base plate 350 and when the lower edge of the roller 341 is supported above the lower edge of the spacer wheel 377 the spacer wheel 377 supports the roller 341 above the hardened slab 2 over which the spacer wheel rolls so that the portion of the roller 341 extending over the uncured concrete will be spaced a set distance above the upper surface of the hardened slab 2 adjacent the hole 15. When concrete cures it shrinks, therefore, spacing the roller 341 a set distance above the slab 2 results in the uncured concrete extending slightly above the hardened slab 2 to accommodate shrinkage of the concrete as it cures to attempt to obtain a level of the cured concrete patch which matches the level of the surrounding slab.

Float Attachment

Figure 29:
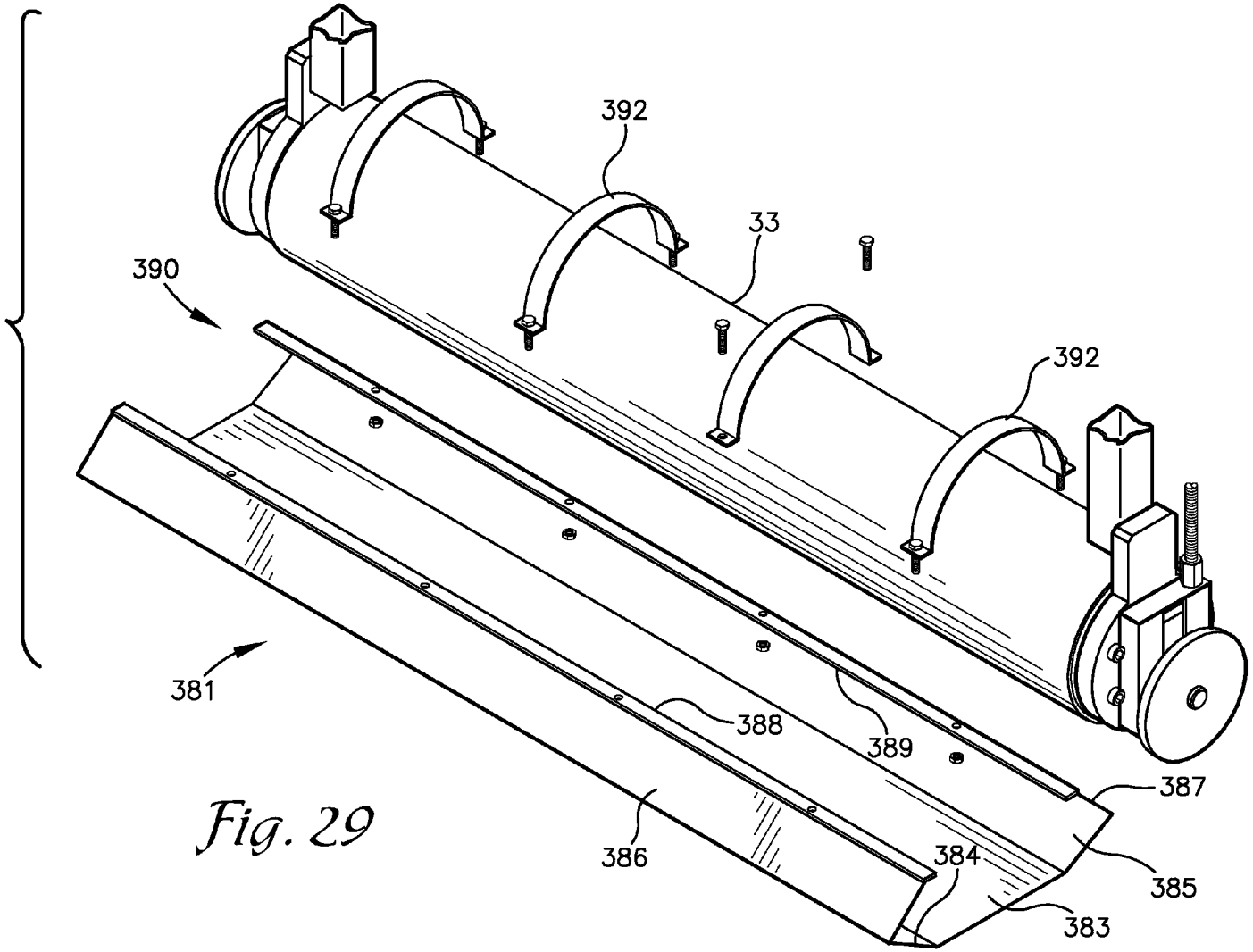
FIG. 29 is an exploded and fragmentary perspective view of a float attachment secured to a screed roller.

Referring to FIG. 29, a float attachment 381 is shown which is removably attachable to one or both of the rollers 32 and 33. The float attachment 381 shown may be formed of sheet metal shaped to include a bottom panel 383 presenting a relatively flat bottom surface and first and second lower side panels 384 and 385 projecting upward and outward from the bottom panel at an angle of between fifteen to about forty five degrees and preferably approximately sixty degrees. The sheet metal is bent back inwards along the outer edges of the first and second lower side panels 384 and 385 to form upper side panels 386 and 387. Mounting flanges 388 and 389 are then formed along an inner edge of each of the upper side panels 386 and 387. The bottom panel 383 is sized to have a width that it approximately the same as the diameter of the rollers 32 and 33. A gap 390 is formed between the mounting flanges 388 and 389 which is slightly wider than the diameter of the rollers 32 and 33. The mounting flanges 388 and 389 are spaced above the bottom panel 383 a distance approximately equal to the radius of the rollers 32 and 33 so that the mounting flanges 388 and 389 are generally spaced in line with a diameter of the roller 32 or 33 to which it is attached when the float attachment 381 is positioned around a roller 32 or 33 and the bottom of the roller 32 or 33 abuts the inner surface of the bottom panel 383. The float attachment 381 is secured to the roller 32 or 33 using semi-circular straps 392 which may also be formed from sheet metal and positioned over the top of the roller 32 or 33. Flanges or feet 393 on the ends of each strap 392 are bolted to the mounting flanges 388 to clamp the float attachment 381 onto the roller 32 or 33.

The bottom panel 383 of the float attachment 381 attached to a roller, such as roller 33, can be advanced over the uncured concrete after initial finishing using the rollers 32 and 33 alone to smooth the surface further. The float attachment 381 attached to roller 32 may be moved over the uncured concrete by moving the concrete finishing machine 21 over the hole 15 or by extending and retracting the front and rear laterally telescoping support members 81 and 82. The roller to which the float attachment is attached, such as roller 33 may be rotated slightly in either direction to slightly angle the orientation of the bottom panel 383 relative to the upper surface of the uncured concrete to be finished. The leading edge of the bottom panel 383 in the direction of advancement of the float attachment 381 over the uncured concrete may be raised slightly by rotating roller 33 to which the attachment 381 is clamped to facilitate smoothing out the concrete.

Hole Traversing Assembly

Figure 30:
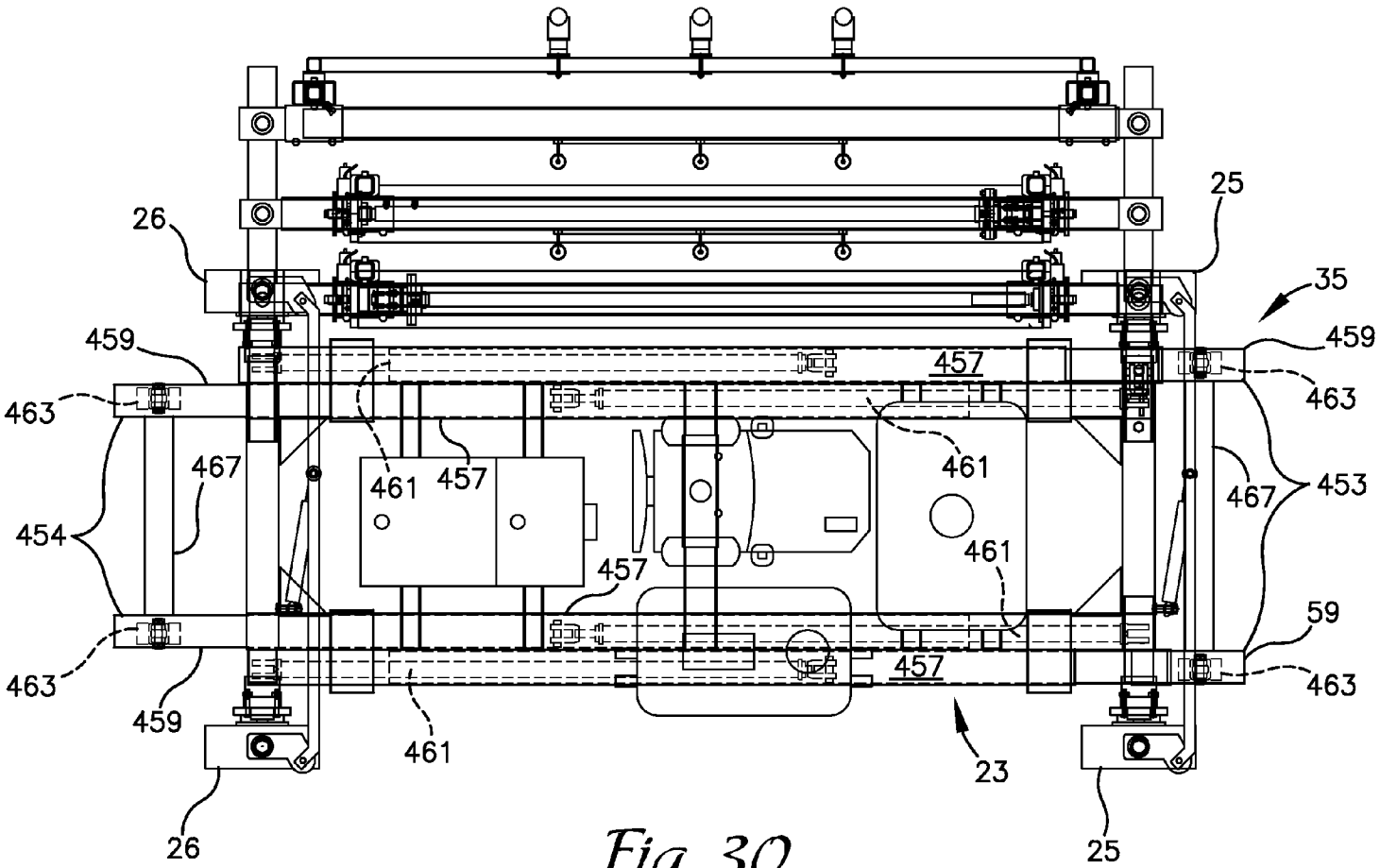
FIG. 30 is a top plan view of the concrete finishing machine with an optional hole traversing assembly mounted to the underside of the chassis and shown in a retracted condition.
Figure 31:
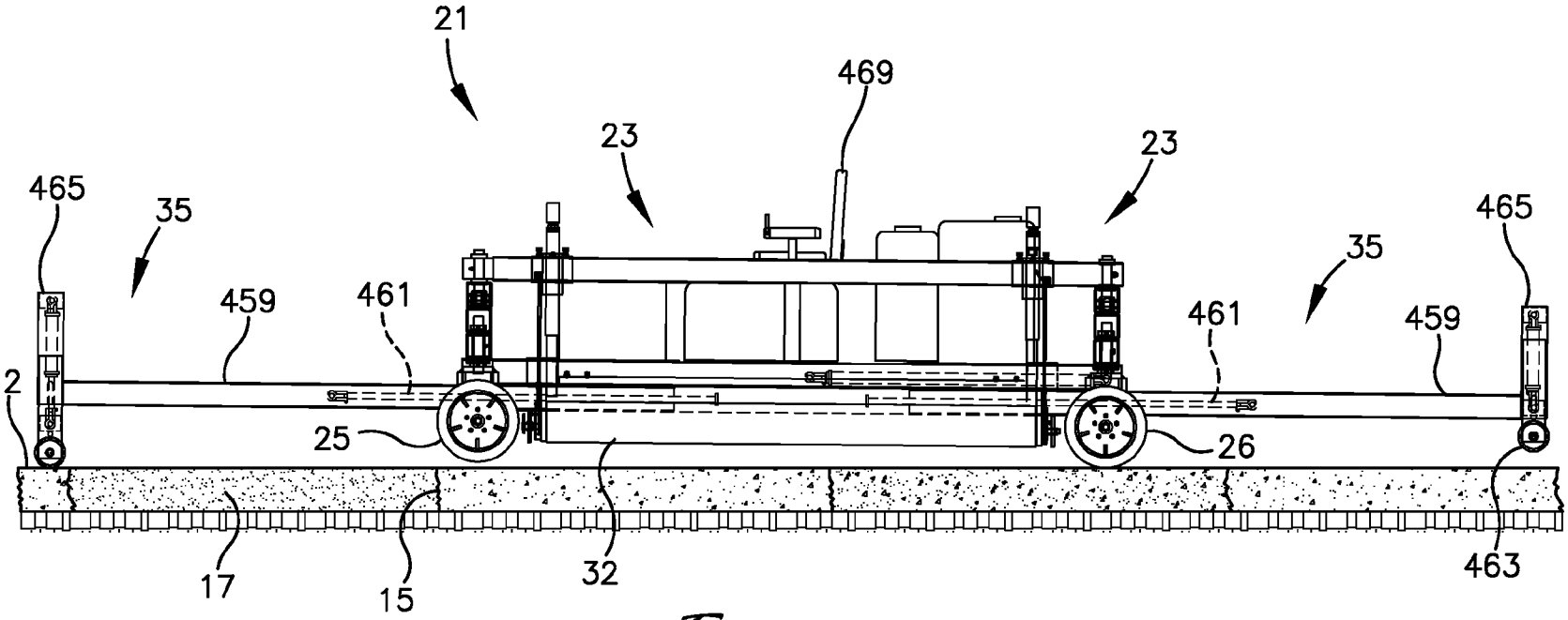
FIG. 31 is a left side view of the concrete finishing machine with the vibrators removed for clarity showing the hole traversing assembly in use lifting a front end and front wheels for traversing over a hole filled with uncured concrete.
Figure 32:
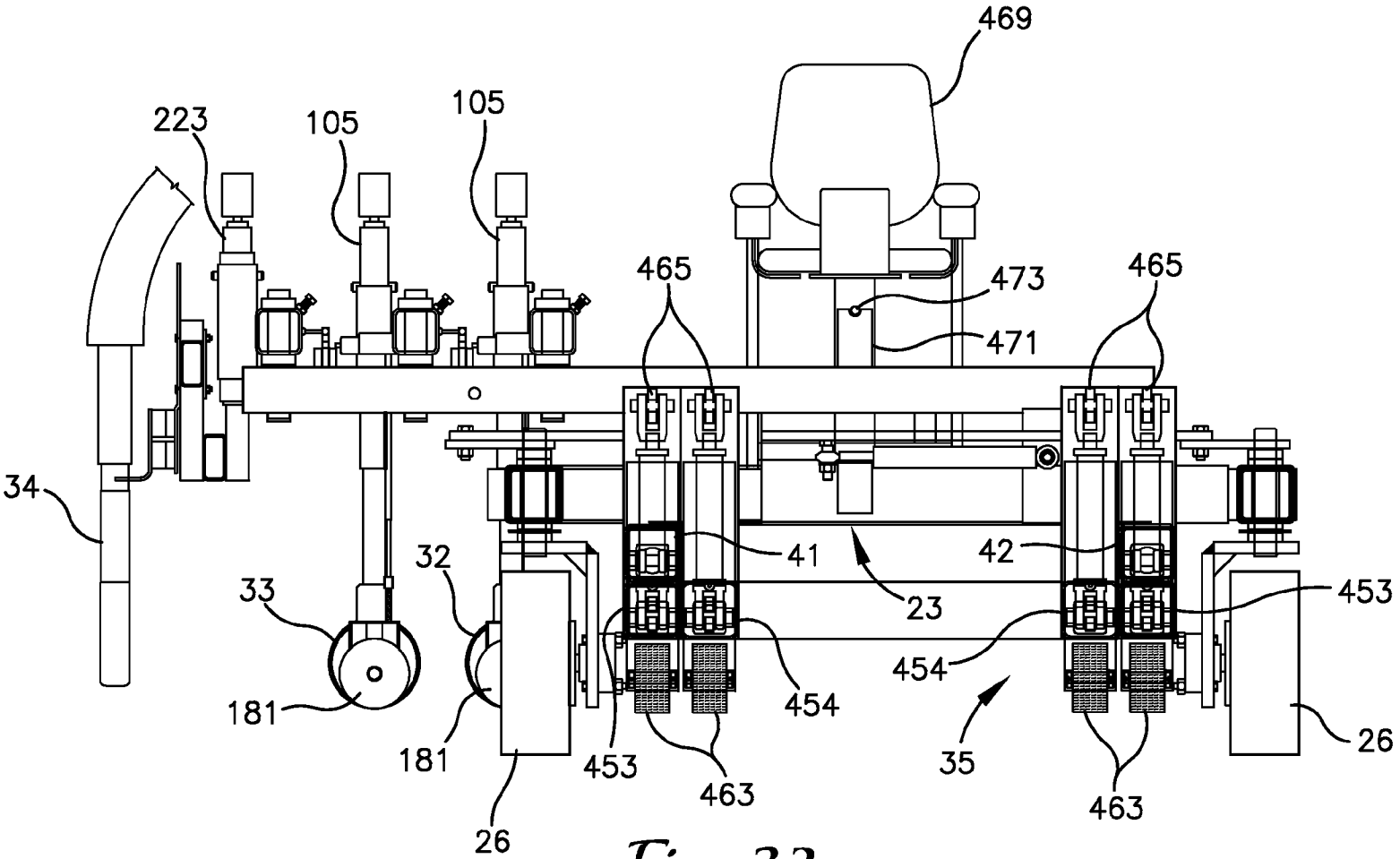
FIG. 32 is a rear elevational view of the concrete finishing machine with the hole traversing assembly secured to an underside of the chassis.

The concrete finishing machine 21 may also incorporate a hole traversing assembly 37 secured to and under the chassis 23 as shown in FIGS. 30 through 32. The hole traversing assembly 37 is used to lift the front and rear wheels 25 and 26 of the concrete finishing machine 21 over a hole 15 filled with concrete, before the concrete has cured and particularly in situations in which the concrete finishing machine 21 cannot approach the hole 15 from an adjacent lane or shoulder but must do so from the lane in which the hole 15 is located. The hole traversing assembly 37 comprises front and rear pairs of telescoping lift assemblies 453 and 454. The rear telescoping lift assemblies 454 are shown mounted inside of the front telescoping lift assemblies 453.

Each lift assembly 453 and 454 comprises an outer tube 457 and an inner tube 459 slidably secured therein and interconnected with a hydraulic actuator 61 for extending and retracting the inner tube 59 relative to the outer tube 457. An idler wheel 463 is connected to a distal end of each inner tube 459 by a hydraulic jack 465 which is operable to advance the idler wheel 463 between retracted and extended positions. In the retracted position, a lower periphery of the idler wheel 463 is supported or spaced above a lower periphery of the front and rear wheels 25 and 26 or above an upper surface of the slab 2 on which the wheels 25 and 26 are supported. As each idler wheel 463 is advanced to an extended position, it initially engages the upper surface of the slab 2 and then further extension of the jack 465 raises the end of the chassis 23 closest to the idler wheel 463. Advancement of idler wheels 463 on the front telescoping lift assemblies 453 raises the front end of the chassis 23 and the front wheels 25 connected thereto off of and above the upper surface of the slab 2. Advancement of the idler wheels 463 on the rear telescoping lift assemblies 454 raises the rear end of the chassis 23 and the rear wheels connected thereto off of and above the upper surface of the slab 2.

The outer tube 457 of each of the front telescoping lift assemblies 453 is welded to the outer tube 44 of a corresponding longitudinal base frame ember 41. The outer tube 457 of each of the rear telescoping lift assemblies 453 is welded to an inner surface of the outer tubes 457 of front telescoping lift assemblies 453 such that all four of the telescoping lift assemblies 453 and 454 are supported by the chassis 23 at the same height. The inner tubes 459 of the front telescoping lift assemblies 453 extend toward the front of the chassis 23 while inner tubes 459 of the rear telescoping lift assemblies 454 extend toward the rear of the chassis 23. Cross-beams 467 are welded between the inner tubes 459 of the front telescoping lift assemblies 453 and between inner tubes 459 of rear telescoping lift assemblies 455. The idler wheels 463 on the inner tubes 459 of the retracted telescoping lift assemblies 453 and 454 extend approximately one foot outward from the front or rear wheels 25 and 26 respectively. The inner tubes 459 are extendable approximately six feet outward from the outer tubes 457 to extend the idler wheels 463 in front of or behind the front or rear wheels 25 or 26 of the chassis 23 by approximately seven feet.

To traverse a hole 15 of up to six feet wide, the finishing machine 21 is advanced toward the hole 15 with the idler wheels 463 raised until the front wheels 25 are just behind the hole 15. The front telescoping lift assemblies 453 are extended until the idler wheels 463 connected thereto are positioned over the slab 2 on the opposite side of the hole 15. Jacks 465 connected to the inner tubes 459 of the front telescoping lift assemblies 453 are extended to lower the idler wheels 463 into engagement with the slab 2 and then further extended to raise the front of the chassis 23 to lift the front wheels 25 off of the slab 2. The rear wheels 26 of the chassis 23 are then operated to move the finishing machine 21 forward until the front and rear wheels 25 and 26 straddle hole 15. The jacks 465 connected to the front idler wheels 463 are then retracted to lower the front wheels 25 of the chassis back into engagement with the slab 2 and until the front idler wheels 463 are lifted above the surface of the slab 2.

Once the finishing machine 21 has finished the concrete in the hole 15, the rear set of jacks 465 are extended until the rear idler wheels 463 engage the slab 2 behind the hole 15 and raise the chassis and rear wheels 26 off of the upper surface of slab 2. The actuators 461 in the rear telescoping lift assemblies 455 are then extended while driving the front wheels 25 forward to advance the rear wheels 26 over the hole 15 in spaced relation above the finished and uncured concrete therein. Once the rear wheels 26 are positioned over the slab 2 on the opposite side of the hole 15, the jacks 465 connected to rear idler wheels 463 are retracted lowering the rear end of the chassis 23 until rear wheels 26 engage the slab 2 on the opposite side of the hole 15. The jacks 465 connected to rear idler wheels 463 are retracted further to lift the rear idler wheels 463 off of the upper surface of the slab 2. The inner tubes 459 are then retracted to draw the idler wheels 463 back toward the chassis 23.

An operator's chair 469 is supported on cross-beam 46 extending between outer tubes 44 of the longitudinal base frame members 41 and 42 medially thereof. More specifically, chair 469 is supported on a vertical swivel assembly 471 which allows the chair 469 to rotate about a vertical axis and with a catch 473 which resists rotation of the chair 469 out of a forward facing orientation (see FIG. 2) or a side facing orientation (see FIG. 3) relative to the finishing machine 21. The vertical swivel assembly 471 is connected at a lower end to a sleeve 475 slidably mounted on cross-beam 46 to allow sliding adjustment of the position of the chair 469 along cross beam 46. The lateral position of sleeve 475 on cross-beam 46 may be fixed with set screws or a latching mechanism selectively releasable by the operator.

A hydraulic fluid supply assembly 479 is mounted on horizontal frame members 481 extending between the outer tubes 44 of the longitudinal base frame members 41 and 42 of chassis 23. The hydraulic fluid supply assembly 479 (shown schematically) includes a hydraulic fluid tank 483, a pump 484 and a gasoline engine or motor 485 for driving the pump. Controls, such as joy sticks 487 and foot pedals 488 mounted on or proximate chair 469 are used by an operator to control the delivery of hydraulic fluid to the hydraulic actuators and motors incorporated into the finishing machine 21 to control its operation.

When the finishing machine 21 is traveling to a hole 15 having uncured concrete placed therein to be finished, the longitudinally telescoping base frame members 41 and 42, the laterally telescoping finisher support members 81 and 82 and the telescoping lift assemblies 453 and 454 are preferably all retracted. The vertically telescoping roller supports 105 and 107 and the vertically telescoping vibrator supports 423 are also retracted enough to lift the screed rollers 32 and 33 and the vibrators 34 above the surface of the slab 2 on which the finishing machine travels. Similarly, the jacks 465 for the idler wheels 463 are retracted to raise the idler wheels 463 above the surface of slab 2. Steering actuators 77 are retracted to cause the steering linkages 71 to advance the front and rear wheels 25 and 26 into longitudinal alignment with the chassis 23 to allow the finishing machine 21 to travel longitudinally down a lane of the slab 2, preferably in a lane adjacent to the lane including the hole 15 in which concrete is to be added and finished. As noted previously, wheels 25 and 26 are driven by wheel motors 64.

Once the front wheels 25 of the finishing machine 21 advance past the hole 15 with the rear wheels positioned on an opposite side of the hole so that the finishing machine spans the width of the hole 15, the steering actuators 77 are extended to cause the steering linkages 71 to pivot the front and rear wheels 25 and 26 ninety degrees to allow the finishing machine 21 to travel transverse to the lane of the slab 2 containing the hole 15 with the front and rear wheels 25 and 26 straddling the hole 15. If the hole 15 is wider than the spacing between front and rear wheels 25 and 26 when the longitudinally telescoping base frame members 41 and 42 are retracted, the longitudinally telescoping base frame members 41 and 42 are extended to increase the spacing between front and rear pairs of wheels 25 and 26 as needed. In the embodiment shown, the wheel spacing may be extended from approximately seven feet to thirteen feet to accommodate holes of up to approximately twelve feet in width.

Uncured concrete is generally placed in the hole 15 either before the finishing machine 21 reaches the hole 15 or after it is positioned adjacent to or in straddling relationship over the hole 15. Once the finishing machine 21 is positioned so that front and rear pairs of wheels 25 and 26 straddle the hole 15 and the wheels 25 and 26 are oriented laterally, the wheel motors 64 are engaged to advance the finishing machine 21 over and across the hole 15. Alternatively laterally telescoping arms 81 and 82 may be extended and retracted to move the screed rollers 32 and 33 or the vibrator assemblies 31 or both over and across the hole 15. In a first pass over the hole 15, the vibrators 34 are lowered into the uncured concrete by extending the vertically telescoping vibrator supports 223. The heads 233 of the vibrators 34, which are hydraulically operated, vibrate in the uncured concrete to fluidize the mass of concrete to allow gravity to pull the concrete into a generally level mass and fill in empty spaces in the hole 15 and eliminate pockets of air in the uncured concrete. It is noted that the vibrator support beam 221 on which vibrators 34 are mounted only extends the length of the outer tube 99 of the telescoping vibrator support 87. When the longitudinally telescoping base frame members are extended to accommodate wider holes, no vibrators 34 are mounted in alignment with the extended inner tube 101 of the telescoping vibrator support 87. In such situations crew members may use hand held vibrators to reach the areas of uncured concrete not reached by the finishing machine 21.

After or during use of the vibrators 34, one or both of the screed rollers 32 and 33 may be lowered into position to engage and roll across the upper surface of the uncured concrete to further level and smooth out an upper surface thereof. When it is desired to terminate use of the vibrators 34, the vertically telescoping vibrator supports 223 are retracted to raise the vibrators 34 above the upper surface of the uncured concrete and the slab 2. Prior to lowering the screed rollers 32 and 33, the height adjustment drive motors 213 for the vertical spacing assemblies 181 are preferably operated to adjust the spacing of the outer periphery of the riser wheels 183 relative to the outer periphery of the screed roller tubes 145 to provide the desired spacing of the tubes 145 above the surface of the slab 2 adjacent hole 15. For example, the spacing may be one eighth or one quarter of an inch. Concrete contracts or shrinks upon hardening, so finishing the uncured concrete to a level slightly higher than the surrounding, previously cured slab 2 will result in a cured patch in the hole 15 that shrinks down to the level of surrounding slab 2. Spacing the tubes 145 of screed rollers 32 and 33 slightly above the cured slab 2 also reduces wear on the outer ends of the tubes 145 which would otherwise contact the relatively hard cured slab 2.

The screed rollers 32 and 33 may be rotated by drive motors 167 at different speeds or in different directions to achieve different characteristics in the finished concrete. It is noted that the outer tubes 44 of the first and second longitudinal base frame members 41 and 42 are connected to opposite laterally telescoping support members 81 and 82, such that when the chassis 23 is extended to allow finishing of wider holes 15, the first and second screed rollers 32 and 33, which are connected to separate outer tubes 44 are drawn apart so that at least a portion of one of the screed rollers 32 and 33 will extend over the wider hole 15 to be finished.

The screed rollers 32 and 33 may also be used to move a mass of uncured concrete from one side of the hole 15 toward another side by angling the rollers 32 and 33 relative to the hole 15. The rollers 32 and 33 are angled by extending one of the laterally telescoping support members 81 or 82 further relative to the other. The screed rollers 32 and 33 may be angled wider towards either the front or rear of the finishing machine 21 and when the chassis 23 is retracted or extended for finishing wider holes 15. Once the uncured concrete placed in the hole 15 is finished and before traveling to the next hole, the screed rollers 32 and 33 are raised by retracting the vertically telescoping roller supports 105 and 107 and the vibrators 34 are also raised if not done so previously. In addition, the laterally telescoping support members 81 and 82 are preferably retracted.

Prior to finishing the concrete a pre-cure composition may be sprayed from pre-cure tank 245, through the nozzles 241 of the first sprayer 235 onto the mass of concrete placed in hole 15 to facilitate finishing of the concrete. After finishing the concrete, a cure composition may be sprayed from cure tank 243 through the nozzles 241 of the second sprayer 237 onto the finished concrete to increase the rate at which the concrete cures.

Figure 33:
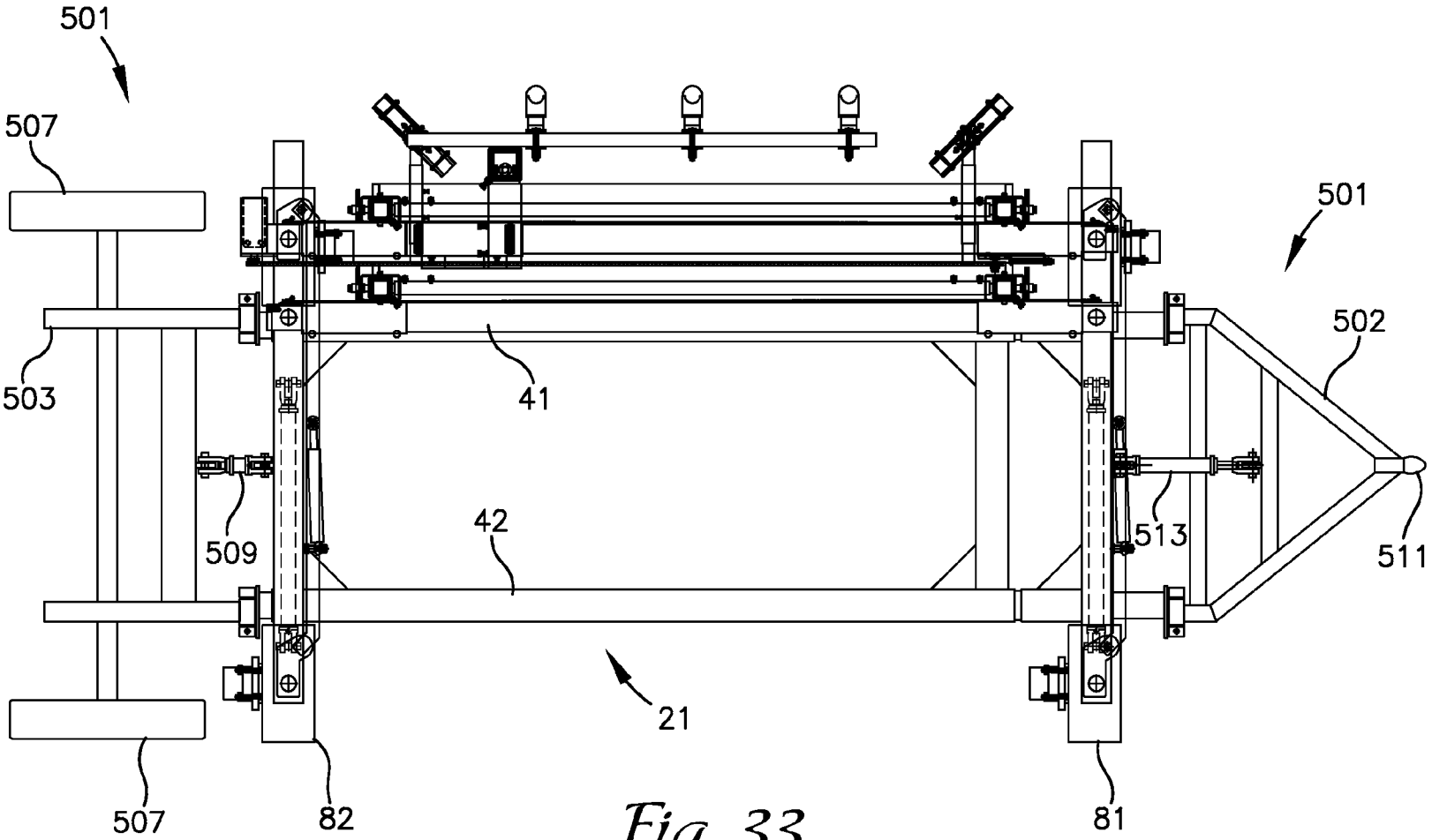
FIG. 33 is a top plan view of the concrete finishing machine with a towing assembly mounted thereon and in a towing alignment.
Figure 34:
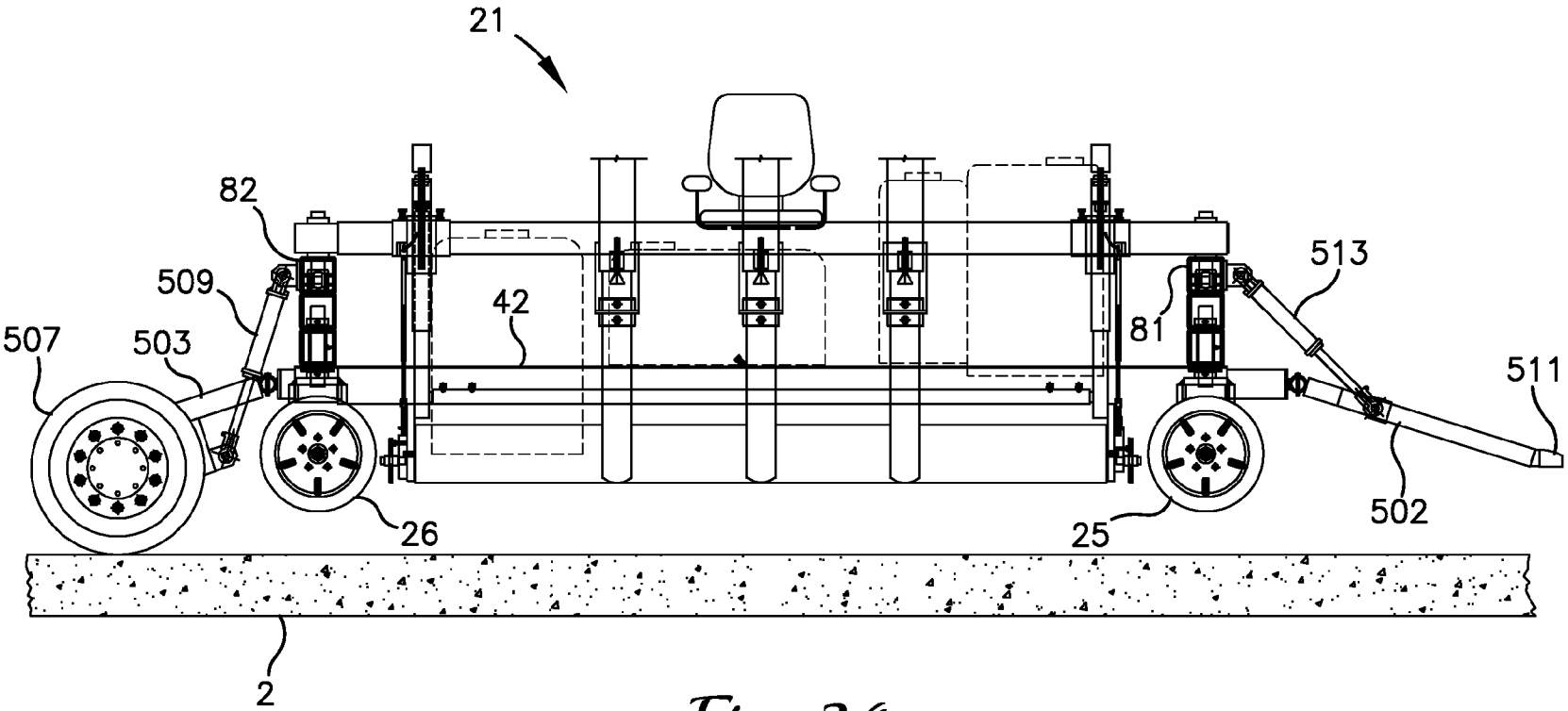
FIG. 34 is a side elevational view of the concrete finishing machine with the towing assembly in a towing alignment.
Figure 35:
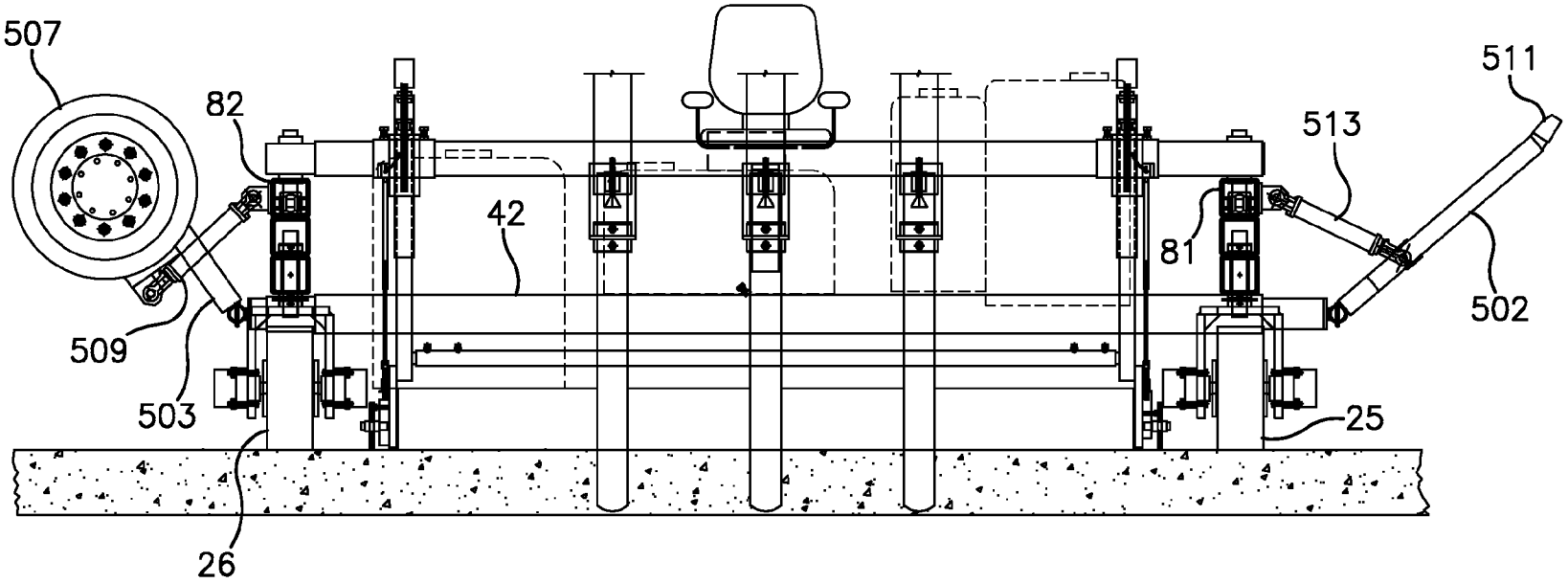
FIG. 35 is a side elevational view of the concrete finishing machine with the towing assembly in a raised alignment.

As shown in FIGS. 33-35, a towing assembly 501 may be attached to or included on the concrete finishing machine 21 to facilitate towing the concrete finishing machine 21 to a work site, such as a section of road to be repaired, at relatively high speeds. The towing assembly 501 includes a tongue 502 and a carriage or truck 503. The carriage 503 includes a carriage frame 505 pivotally connected to the rear ends of the first and second longitudinally telescoping base frame members 41 and 42. Wheels 507 are rotatably mounted on opposite sides of the carriage frame 505. A hydraulic actuator 509 is pivotally connected at a first end to the outer tube 89 of the rear laterally telescoping support member 82 and at a second end to the carriage frame 505. The hydraulic actuator 509 is operable to raise and lower the carriage 503 relative to the ground as discussed in more detail hereafter.

The tongue 502 is pivotally connected at a rear end to the front ends of the first and second longitudinally telescoping base frame members 41 and 42. A coupler 511 is mounted on the front end of the tongue 502 and is adapted to receive and connect to a hitch ball (not shown) of a hitch connected to a truck for towing the concrete finishing machine 21. A hydraulic actuator 513 is pivotally connected at a first end to the outer tube 89 of the front laterally telescoping support member 81 and at a second end to the tongue 502. The tongue hydraulic actuator 513 is operable to raise and lower the tongue relative to a hitch ball.

As generally shown in FIG. 34, when the towing assembly 501 is to be used to connect the concrete finishing machine 21 to a truck for towing, the hydraulic actuator 509 is extended to lower the wheels 507 on carriage 503 into engagement with the ground and the coupler 511 on the tongue 502 into engagement with a hitch ball on a towing vehicle (not shown). Further extension of carriage actuator 509 raises the rear end of the concrete finishing machine 21 including rear wheels 26 off of the ground and further extension of tongue actuator 513 raises the front end of the concrete finishing machine 21 and the front wheels 25 off of the ground. With the front and rear wheels 25 and 26 supported above the ground or slab 2 on wheels 507 and the hitch of a towing vehicle, the concrete finishing machine 21 may be towed at higher speeds than can be obtained by driving wheels 25 and 26 with hydraulic motors as discussed previously.

When the concrete finishing machine 21 has been towed to a work site or an area in which repairs to a slab are to be made, the actuators 509 and 513 are initially retracted until the rear and front wheels 26 and 25 are lowered to the ground to support the concrete finishing machine 21. The coupler 511 is disconnected from the hitch ball of the tow vehicle and then the actuators 509 and 513 are further retracted to raise the carriage 503 and tongue 502 further so that they do not interfere with operation of the concrete finishing machine as shown in FIG. 35.

The concrete finishing machine 21 is sized to be legally transportable on all roads while in a retracted configuration so that it can be towed by a tow vehicle. The machine 21 can also operate in only one lane of a road if necessary and can traverse across holes 15 while staying in the lane using the hole traversing assembly 37 as described herein. The ability to steer the front wheels 25 independent of the rear wheels 26 permits of the concrete finishing machine 21 to complete a ninety degree turn and immediately begin paving or finishing a patch of uncured concrete.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A concrete finishing machine for leveling a mass of uncured concrete comprising a screed roller connected between first and second roller support members, the screed roller comprises a tube having a first hub connected to said tube in inwardly spaced relation from a first end thereof and a second hub connected to said tube and rotatably connected to the second support member, the screed roller further comprises a drive motor connected to the first support member and having a drive shaft drivingly engaging the first hub to rotate the tube relative to the first and second support members and wherein the drive motor extends within the tube.

2. The concrete finishing machine as in claim 1 wherein the drive motor extends completely within the tube.

3. The concrete finishing machine as in claim 1 further comprising a first roller support wheel connected to the first roller support member and rotatable about an axis aligned with or extending in parallel and spaced relation to the axis of rotation of said screed roller and a second roller support wheel connected to the second roller support member and rotatable about an axis aligned with or extending in parallel and spaced relation to the axis of rotation of said screed roller.

4. The concrete finishing machine as in claim 3 wherein said first roller support wheel is rotatably mounted on a first wheel mount which is connected to the first roller support member outward from the first end of the screed roller and said second roller support wheel is rotatably mounted on a second wheel mount which is connected to the second roller support member outward from the second end of the screed roller, the position of each of the first and second wheel mounts is vertically adjustable relative to the screed roller such that the axis of rotation of each of the first and second roller support wheels is vertically adjustable in a plane extending vertically through the axis of rotation of the screed roller.

5. The concrete finishing machine as in claim 4 further comprising means for selectively holding a lower peripheral edge of each of the first and second roller support wheels in spaced relation below a lower peripheral edge of the screed roller.

6. The concrete finishing machine as in claim 4 wherein the first and second wheel mounts are slidably mounted relative to the screed roller and first and second vertically adjustable stops selectively restrain vertical sliding of the first and second wheel mounts to hold a lower peripheral edge of each of the first and second roller support wheels below a lower peripheral edge of the screed roller.

7. A concrete finishing machine for finishing a mass of uncured concrete in a hole formed in a slab, the machine comprising a frame having a front pair of powered drive means and a rear pair of powered dive means connected to and supporting the frame above a surface and at least one screed suspended from the frame to extend generally horizontally with each of the front and rear pairs of drive means spaced outward from first and second ends of the at least one screed and wherein said front and rear pairs of drive means are selectively operable to advance said concrete finishing machine in a first direction generally parallel to a longitudinal axis of the screed and in a second direction generally transverse to the longitudinal axis of the screed without turning the frame, wherein, when advancing in the second direction, the outward spacing of said front and rear pairs of powered drive means from first and second ends of the at least one screed permits the front and rear pairs of powered drive means to support the concrete finishing machine on the slab in which the hole is formed on opposite sides thereof such that the at least one screed may be advanced across the hole with the front and rear pairs of powered drive means extending in straddling relation to the hole.

8. The concrete finishing machine as in claim 7 wherein said at least one screed comprises a screed roller connected between first and second roller support members, the screed roller comprises a tube having a first hub connected to said tube in inwardly spaced relation from a first end thereof and a second hub connected to said tube and rotatably connected to the second support member, the screed roller further comprises a drive motor connected to the first support member and having a drive shaft drivingly engaging the first hub to rotate the tube relative to the first and second support members and wherein the drive motor extends within the tube.

9. The concrete finishing machine as in claim 8 wherein the drive motor extends completely within the tube.

10. The concrete finishing machine as in claim 8 further comprising a first roller support wheel connected to the first roller support member and rotatable about an axis aligned with or extending in parallel and spaced relation to the axis of rotation of said screed roller and a second roller support wheel connected to the second roller support member and rotatable about an axis aligned with or extending in parallel and spaced relation to the axis of rotation of said screed roller.

11. A concrete finishing machine for leveling a mass of uncured concrete comprising:

a screed roller rotatably mounted between first and second roller support members, a first roller support wheel rotatably mounted on a first wheel mount which is connected to the first roller support member outward from the first end of the screed roller and a second roller support wheel rotatably mounted on a second wheel mount which is connected to the second roller support member outward from the second end of the screed roller; wherein the position of each of the first and second wheel mounts is vertically adjustable relative to the screed roller such that the axis of rotation of each of the first and second roller support wheels is vertically adjustable in a plane extending vertically through the axis of rotation of the screed roller.

12. The concrete finishing machine as in claim 11 further comprising means for selectively holding a lower peripheral edge of each of the first and second roller support wheels in spaced relation below a lower peripheral edge of the screed roller.

13. The concrete finishing machine as in claim 11 wherein the first and second wheel mounts are slidably mounted relative to the screed roller and first and second vertically adjustable stops selectively restrain vertical sliding of the first and second wheel mounts to hold a lower peripheral edge of each of the first and second roller support wheels below a lower peripheral edge of the screed roller.

* * * * *